US009174078B2

(12) United States Patent
Fischer et al.

(10) Patent No.: US 9,174,078 B2
(45) Date of Patent: Nov. 3, 2015

(54) RESIDENTIAL SIDEWALL FIRE SPRINKLER

(75) Inventors: Michael A. Fischer, West Kingston, RI (US); Marcelo J. Chavez, Providence, RI (US); Timothy P. Hurley, North Oxford, MA (US); Manuel R. Silva, Jr., Cranston, RI (US)

(73) Assignee: Tyco Fire Products LP, Lansdale, PA (US)

( * ) Notice: Subject to any disclaimer, the term of this patent is extended or adjusted under 35 U.S.C. 154(b) by 1616 days.

(21) Appl. No.: 12/374,790

(22) PCT Filed: Jul. 30, 2007

(86) PCT No.: PCT/US2007/074728

§ 371 (c)(1),
(2), (4) Date: Dec. 1, 2009

(87) PCT Pub. No.: WO2008/024598

PCT Pub. Date: Feb. 28, 2008

(65) Prior Publication Data

US 2010/0078181 A1 Apr. 1, 2010

Related U.S. Application Data

(60) Provisional application No. 60/820,660, filed on Jul. 28, 2006.

(51) Int. Cl.

| | |
|---|---|
| ***A62C 37/08*** | (2006.01) |
| ***A62C 37/00*** | (2006.01) |
| ***A62C 37/50*** | (2006.01) |

(52) U.S. Cl.

CPC ..... *A62C 37/08* (2013.01); *Y10T 29/49826* (2015.01)

(58) Field of Classification Search

CPC ..... A62C 37/08; Y10T 29/49826

USPC ..... 169/38, 40, 41, 42, 56, 57, 58, 59, 60, 169/61, 90, DIG. 3, 37; 239/461, 476, 482, 239/483, 498, 499, 500, 501, 502, 504, 507, 239/509, 518, 523, 524, 521, 522, 208, 209, 239/207

See application file for complete search history.

(56) References Cited

U.S. PATENT DOCUMENTS

| | | | |
|---|---|---|---|
| 2,046,169 | A | 6/1936 | Knight |
| 2,101,694 | A | 12/1937 | Tyden |

(Continued)

OTHER PUBLICATIONS

International Search Report, PCT/US2007/074728.

(Continued)

*Primary Examiner* — Len Tran
*Assistant Examiner* — Steven M Cernoch
(74) *Attorney, Agent, or Firm* — Perkins Coie LLP

(57) ABSTRACT

A residential sidewall sprinkler and system for a coverage area defined by a pair of parallel vertical walls. The sprinkler includes a body having a passageway defining a K-factor of about 6. The body has an inlet coupled to a fluid supply line and a distal end coupled to a deflector assembly. The deflector assembly includes a face portion with an upper canopy and a lower canopy disposed about the face portion. The sprinkler is mounted to one of the walls to define a ceiling-to-deflector distance ranging from about four inches to about twelve inches. The fluid supply at the inlet is at least at one of a substantially constant flow rate of fluid and substantially constant fluid pressure. The deflector assembly distributes the fluid over the coverage area so as to wet the vertical walls within about twenty-eight inches of the ceiling over the ceiling-to-deflector range.

54 Claims, 6 Drawing Sheets

(56) References Cited

U.S. PATENT DOCUMENTS

| | | | | | |
|---|---|---|---|---|---|
| 2,135,138 | A | * | 11/1938 | Clayton Kendall Horace | 239/498 |
| 3,880,239 | A | | 4/1975 | Vorkapich | |
| 3,904,126 | A | | 9/1975 | Allard | |
| 4,014,388 | A | | 3/1977 | Anderson | |
| 4,296,815 | A | * | 10/1981 | Mears | 169/37 |
| 4,296,816 | A | | 10/1981 | Fischer | |
| 4,585,069 | A | * | 4/1986 | Whitaker | 169/37 |
| H121 | H | | 9/1986 | Pieczkolan | |
| 4,987,957 | A | * | 1/1991 | Galaszewski | 169/37 |
| 5,669,449 | A | | 9/1997 | Polan et al. | |
| 5,722,599 | A | * | 3/1998 | Fries | 239/504 |
| 5,727,737 | A | | 3/1998 | Bosio et al. | |
| 5,810,263 | A | | 9/1998 | Tramm | |
| 6,059,044 | A | * | 5/2000 | Fischer | 169/37 |
| 6,098,718 | A | | 8/2000 | Sato | |
| 6,276,460 | B1 | * | 8/2001 | Pahila | 169/37 |
| 6,367,559 | B1 | | 4/2002 | Winebrenner | |
| 6,374,919 | B1 | | 4/2002 | Neill | |
| 6,520,265 | B2 | | 2/2003 | Winebrenner | |
| 6,799,639 | B2 | | 10/2004 | Sato et al. | |
| 6,889,774 | B2 | | 5/2005 | Multer et al. | |
| 6,920,937 | B2 | | 7/2005 | Neill et al. | |
| 7,137,455 | B2 | | 11/2006 | Green | |
| 7,275,603 | B2 | | 10/2007 | Polan | |
| 7,353,882 | B2 | | 4/2008 | Pahila | |
| 7,614,457 | B2 | | 11/2009 | Green | |
| 7,784,555 | B2 | | 8/2010 | Pahila | |
| 7,854,269 | B2 | * | 12/2010 | Franson et al. | 169/37 |
| 2003/0160111 | A1 | * | 8/2003 | Multer et al. | 239/209 |
| 2006/0219818 | A1 | | 10/2006 | Franson et al. | |
| 2011/0127050 | A1 | | 6/2011 | Pahila et al. | |

OTHER PUBLICATIONS

International Preliminary Report on Patentability and Written Opinion of the International Searching Authority in PCT/US2007/074728.

U.S. Appl. No. 60/820,660, filed Jul. 28, 2006. Aug. 13, 2013 Image File Wrapper from the USPTO, 43 pages.

National Fire Protection Association (NFPA), NFPA 13: Standard for the Installation of Sprinkler Systems, 2002 Edition, 334 pages.

National Fire Protection Association (NFPA),NFPA 13D: Installation of Sprinkler Systems in One- and Two- Family Dwellings and Manufactured Homes, 2002 Edition, 30 pages.

National Fire Protection Association (NFPA), NFPA 13R: Standard for the Installation of Sprinkler System..and Including Four Stories in Height, 2002 edition, 27 pages.

Underwriters Laboratory Incorporated ("UL"), "UL 1626: Residential Fire Sprinklers for Fire-Protection Service" (Oct. 2003), 70 pages.

Reliable, Model MBEC-14 Datasheet, Extended Coverage Ordinary & Extra Hazard Horizontal Sidewall . . .Applications, Bulletin 169, Rev. D, Oct. 2005, 6 pages.

Image File Wrapper (IFW) of European Application No. 07 840 585.9, Aug. 13, 2013 from the EPO Patent Register, 198 pages.

Response to Communication Pursuant to Article 94(3) issued by EPC in related copending European Regional Patent Application No. 07 840 585.9, Oct. 7, 2010, 33 pages.

Examination Report issued in related copending European Regional Patent Application No. 07 840 585.9, Jun. 8, 2012, 4 pages.

Response to Jun. 8, 2012 Examination Report issued in related copending European Regional Patent Application No. 07 840 585.9, Oct. 3, 2012, 12 pages.

Tyco Fire & Building Products, Data Sheet, Model SW-20 and SW24—11.2 K-factor Extended Coverage..(Standard Response), TFP230, Jan. 2005, 6 pages.

The Viking Corporation, Data Sheet, Quick Response Ordinary Hazard Dry Hsw Sprinklers, Sprinkler 106i-106r, Apr. 13, 2007, 8 pages.

The Viking Corporation, Data Sheet, Standard Response Ordinary Hazard Dry HSW Sprinklers, Sprinkler 102j-102p, Apr. 13, 2007, 8 pages.

Grinnell Corporation, Catalog sheet "Horizontal Sidewall SPR. 140°F RES/QR-EC & 165°F RES/QU-EC/EC, Model FR-1, FR . . ., 17/32" (20 MM) Orifice TD589, 8 pp. Mar. 1995.

Grinnell Corporation, Catalog sheet "Horizontal Sidewall Sprinklers RES/QR-EC Model FR-1, Fast Response Solder Type, 1/2" (15 MM) Orifice TD588, 8 pp., Mar. 1995.

Grinnell Corporation, Catalog sheet "Dry Horizontal Sidewall Sprinklers, EC Model F960/Q-48 Designer, 1/2" Orifice, TD557, 6 pp., Nov. 1992.

Grinnell, Catalog sheet "Automatic Sprinklers, Model F950 Duraspeed Extended Coverage Horizontal Sidewall With Q-45 Deflector", Sec. 5 AS/17, 2 pp., Jan. 1979.

Grinnell Corporation, Catalog sheet "Extended Coverage Horizontal Sidewall Sprinklers Models F950/Q-48 and 1F950/Q-48, Solder Type, 17/32" Orifice, TD548, 4 pp., Sep. 1987.

Grinnell Corporation, Catalog sheet "Hor. Sidewall & Recessed Hor. Sidewall Spr. Univ. Model A . . .Bulb Type, 17/32" (20 mm) Orifice, 3/4"NPT**" TD547, 8 pp., May 1996.

Grinnell Corporation, Catalog sheet "Extended Coverage Horizontal Sidewall Sprinklers Models F950/Q-48 and 1F950/Q-48, Solder Type, 1/2 Orifice", TD546, 4 pp., Sep. 1987.

Grinnell Corporation, Catalog sheet "Hor. Sidewall & Recessed Hor. Sidewall Spr. Universal Model a . . .Bulb Type, 1/2" (15 mm) Orifice, 1/2" NPT**" TD545, 8 pp., May 1996.

Grinnell, Bulletin No. 219, "Sprinklers, Nozzles and Accessories/Section 4 Grinnell Sidewall Sprinkler, Model F950 Q33, Style: Horizontal Extended Coverage", 2 pp., Aug. 1975.

Grinnell, Bulletin No. 220, "Sprinklers, Nozzles and Accessories/Section 4 Grinnell Sidewall Spr., Model F 950 Q33, Style: Horizontal Extended Coverage", 2 pp., Aug. 1975.

Grinnell Corporation, Catalog sheet "Dry Horizontal Sidewall Sprinklers Model F960/Q46 Designer, 1/2" Orifice, TD555, 4 pp., Nov. 1992.

Grinnell Corporation, Catalog sheet "Horizontal Sidewall Sprinkler Model F950/Q-46 Solder Type, 1/2" Orifice, TD536, 2 pp., Sep. 1987.

Grinnell Corporation, Catalog sheet "Hor. Sidewall & Rec. Hor. Sidewall Spr. Univ. Model A/Q-71, SR, 5 mm Bulb Type, 1/2" (15 mm) Orifice, 1/2NPT** TD535M, 5 pp., May 1996.

Grinnell Corporation, Catalog sheet "Horizontal Sidewall Sprinklers, Model FR-1/Q-46, Fast Response Solder Type, 1/2" Orifice, TD535, 4 pp., Sep. 1992.

Grinnell Corporation, Catalog sheet "Hor. Sidewall & Rec. Hor. Sidewall Spr. Univ. Model A/Q-71,QR, 3 mm Bulb Type, 1/2" (15 mm) Orifice, 1/2" NPT**" TD534, 6 pp., Dec. 1996.

Grinnell Corporation, Catalog sheet "Automatic Spr., Model F950 Duraspeed Horizontal Sidewall With Q-31 Deflector, 1/2" Orifice Sec. 5 AS/11, 2 pp., Jan. 1979.

Central Sprinkler Corp.,Catalog sheet entitled "Sidewall Sprinkler-H", 4 pp., Aug. 1987.

Central Sprinkler Corp., Catalog sheet "Sidewall Sprinkler-H 17/32", 4 pp., Aug. 1987.

Central Sprinkler Corp., Catalog sheet entitled "Sidewall Sprinkler-HF 17/32", 4 pp., Aug. 1987.

Central Sprinkler Corp., Bulletin HORS-H-1, Rev. No. 4, entitled "Model "H-1" Dry Horizontal Sidewall Sprinkler", 2 pp., Apr. 1986.

Central Sprinkler Corp., Bulletin HORS-H-1 ADJ, Rev. No. 4, entitled "Model "H-1 Adjustable" Dry Horizontal Sidewall Sprinkler", 2 pp., Apr. 1986.

Communication Pursuant to Article 94(3) issued by EPC in related co-pending European Regional Patent Application No. 07840585.9-1258, Mar. 4, 2010, 6 pages.

The Reliable Automatic Sprinkler Co., Datasheet, Model G Sidewall, Model G/F1 Recessed Sidewall Sprinklers, Bulletin 112V, Dec. 2000, 4 pp.

Tyco Fire & Bldg Products, Datasheet, Series LFII Residential Horizontal Sidewall Spr 4.2 K-factor, TFP410, Jan. 2006, 8 pp.

Tyco Fire & Bldg Products, Datasheet, Model TFP PH5 5.6 K-factor Inst. Horizontal Sidewall Sprinklers Standard Resp., Standard Coverage, TFP654, Apr. 2004, 4 pp.

(56) References Cited

OTHER PUBLICATIONS

Tyco Fire & Bldg Products, Datasheet, Model TFP Max 5.6 K-factor Inst. Horizontal Sidewall Sprinklers Quick Resp., Standard Coverage, TFP656, Apr. 2004, 4 pp.
Tyco Fire & Bldg Products, Datasheet, Model TY-B 5.6 K-factor Horizontal and Vertical Sidewall Sprinklers Standard Resp., Standard Coverage, TFP161, Apr. 2006, 6 pp.
Tyco Fire & Bldg Products, Datasheet, Model TY-FRL 5.6 K-factor Horizontal Sidewall Sprinklers Quick Resp., Standard Coverage, TFP140, Jul. 2004, 4 pp.
Tyco Fire & Bldg Products, Datasheet, Series LFII Residential NFPA 13 Optimized Horizontal Sidewall Spr 5.6 K-factor, TFP415, Jan. 2006, 6 pp.
Tyco Fire & Bldg Products, Datasheet, Model TY-FRB 5.6 K-factor Horizontal and Vertical Sidewall Sprinklers Quick Resp., Standard Coverage, TFP176, Apr. 2006, 6 pp.
Tyco Fire & Bldg Products, Datasheet, Series LFII Residential Flush Horizontal Sidewall Spr 4.2 K-factor, TFP425, Jan. 2006, 6 pp.
Tyco Fire & Bldg Products, Datasheet, Series EC-5 5.6 K-factor Extended Coverage Hor. Sidewall Spr., Quick and Stand. Response, TFP298, Jan. 2005, 6 pp.
Tyco Fire & Bldg Products, Datasheet, Model TY-FRL 5.6 and 8.0 K-factor Extended Coverage Horizontal Sidewall Spr. Quick and Standard Response, TFP280, Jan. 2005, 6 pp.
Victaulic Company, Datasheet, V34, K8.0 Models V3409 and V3410 Standard Spray Hor. Sidewall and Recessed Hor. . . .Response, Bulletin 40.16, Rev. E, Apr. 2006, 8 pp.
Victaulic Company, Datasheet, V27, K4.2 Models V2738 Residential Hor. Sidewall and Recessed Hor. . . . Quick Response, Bulletin 40.54, Rev. B, 2004, 8 pp.
Victaulic Company, Datasheet, V36, K5.6 Models V3609 and V3610 Dry Type Standard Spray Hor. Sidewall and Recessed Horizontal Sidewall, Bulletin 40.64, Rev. H, 2004, 8 pp.
Victaulic Company, Datasheet, V36, K8.0 Models V3611 and V3612 Dry Type Standard Spray Hor. Sidewall and Recessed Horizontal Sidewall, Bulletin 40.65, Rev. H, 2006, 7 pp.
Examiner's Report issued in related copending Canadian Patent Application No. 2,658,789, Oct. 22, 2013, 3 pages.
Response to Oct. 22, 2013 Examiner's Report issued in related copending Canadian Patent Application No. 2,658,789, Apr. 16, 2014, 19 pages.
Examination Report issued in related copending European Regional Patent Application No. 07 840 585.9, May 12, 2015, 4 pages.

* cited by examiner

RESIDENTIAL SIDEWALL FIRE SPRINKLER

PRIORITY DATA & INCORPORATION BY REFERENCE

This is a National Stage application under 35 U.S.C. 371 of International Application No. PCT/US2007/074728, filed Jul. 30, 2007, which claims the benefit of priority to (i) U.S. Provisional Patent Application No. 60/820,660 filed Jul. 28, 2006, each of which is incorporated by reference in its entirety.

TECHNICAL FIELD

This invention relates generally to residential fire protection systems and the method of their design and installation. More specifically, the present invention provides a residential sidewall sprinkler and the method of configuring and installing such a sprinkler.

BACKGROUND OF THE INVENTION

An automatic sprinkler system is one of the most widely used devices for fire protection. These systems have sprinklers that are activated once the ambient temperature in an environment, such as a room or a building, exceeds a predetermined value. Once activated, the sprinklers distribute fire-extinguishing fluid, preferably water, in the room or building. A sprinkler system, depending on its specified configuration is considered effective if it controls or suppresses a fire. Failures of such systems may occur when the system has been rendered inoperative during building alteration or disuse, or the occupancy hazard has been increased beyond initial system capability.

The sprinkler system can be provided with a suitable fire fighting fluid or a water supply (e.g., a reservoir or from a municipal water supply). Such supply may be separate from that used by a fire department. Regardless of the type of supply, the sprinkler system is provided with a main that enters the building to supply a riser. Connected at the riser are valves, meters, and, preferably, an alarm to sound when water flow within the system is above or below a predetermined minimum value. At the top of a vertical riser, a horizontally disposed array of pipes extends throughout the fire compartment in the building. Other risers may feed distribution networks to systems in adjacent fire compartments. Compartmentalization can divide a large building horizontally, on a single floor, and vertically, floor to floor. Thus, several sprinkler systems may serve one building.

In a piping distribution network, branch lines carry the sprinklers. A sprinkler may extend in a pendant, upright or horizontal fashion from a branch line, placing the sprinkler relatively close to the ceiling. For a horizontal sprinkler, the sprinkler may be located, for example, between four and twelve inches below the ceiling.

Various standards exist for the design and installation of a fire protection system. For example, National Fire Protection Association ("NFPA") publishes the following standards for the design and installation of fire protection systems: (i) "NFPA 13: Installation of Sprinkler Systems" (2002) (hereinafter "NFPA 13 (2002)"); (ii) "NFPA 13D: Installation of Sprinkler Systems In One- and Two-Family Dwellings and Manufactured Homes" (2002) (hereinafter "NFPA 13D (2002)"); and (iii) "NFPA 13R: Standard For the Installation of Sprinkler Systems in Residential Occupants Up To and Including Four Stories In Height" (2002) (hereinafter "NFPA 13R (2002)") and collectively referred to herein as "NFPA 13, 13D, and 13R (2002)." NFPA 13, 13D, and 13R (2002) and any of their updated editions, such as NFPA 13 (2007), provide various design considerations and installation parameters for a fire protection system. NFPA 13, 13D, and 13R (2002) recognize the use of residential sprinklers by requiring that such a sprinkler in a residential fire protection system be installed based on certain criteria for residential occupancies, which can include commercial dwelling units (e.g., rental apartments, lodging and rooming houses, board and care facilities, hospitals, motels or hotels).

In order, however, for a residential sprinkler to be approved for installation under NFPA Standards, such as NFPA 13, 13D and 13R (2002), the sprinkler typically must pass various tests promulgated by, for example, Underwriters Laboratory Incorporated ("UL") in its standard entitled "UL 1626: Residential Fire Sprinklers For Fire-Protection Service" (October 2003) (hereinafter "UL Standard 1626 (October 2003)" and which is incorporated by reference in its entirety), in order to be listed for use as a residential sprinkler. Specifically, UL Standard 1626 (October 2003) requires a sprinkler, as described in Table 6.1 of Section 6, to deliver a minimum flow rate (gallons per minute or "GPM") for a specified coverage area (square feet or "$ft^2$") to provide for a desired average density of 0.05 GPM/$ft^2$. The minimum flow rate tabulated in Table 6.1 can be used to calculate a predicted minimum fluid pressure needed to operate a sprinkler by virtue of a rated K-factor of the sprinkler. A rated K-factor of a sprinkler provides a coefficient of discharge of the flow passage of the sprinkler, is defined as follow:

$$K-\text{factor}=\frac{Q}{\sqrt{p}}$$

where Q is the flow rate in GPM and p is the pressure in pounds per square inch gauge.

In order for a sprinkler to pass actual fluid distribution tests, as described in Sections 26 and 27 of UL Standard 1626 (October 2003), the actual minimum pressure of the sprinkler, may not be the same as the predicted minimum pressure, which can be calculated using the given minimum flow rate of Table 6.1 in UL Standard 1626 (October 2003) and the rated K-factor of the sprinkler. Further, the actual minimum fluid flow rate to pass these distribution tests of UL Standard 1626 (October 2003) for a specified coverage area may even be higher than the tabulated minimum flow rate given in Table 6.1 of UL Standard 1626 (October 2003). Consequently, any attempt to provide for a listed sprinkler (i.e., an operational sprinkler suitable for the protection of a dwelling unit) cannot be predicted by applications of a known formula to known residential sprinklers.

Known residential sidewall fire sprinklers have been tested to meet these performance qualifications required by UL Standard 1626 (October 2003). When these known sprinklers are designed to be installed in an actual system according to NFPA 13, 13D, and 13R (2002) for a large protection area of 324 square feet or greater, however, these existing residential fire sprinklers require a fluid pressure, based on its discharge coefficient or K-factor, that places a greater demand on the fluid pressure source than that predicted by the application of the tabulated minimum flow rate of UL Standard 1626 (October 2003) and the rated K-factor. Moreover, for some sprinklers, the range of uniform pressure and flows to satisfy the standards vary widely depending on spacing of the sprinkler from the ceiling, i.e., the ceiling-to-deflector spacing.

It would be beneficial to provide for a residential sprinkler to achieve a more uniform pressure demand independent of distance from the ceiling, while meeting the performance requirements of a listing authority, such as, for example, the tests set forth in UL Standard 1626 (October 2003), including vertical and horizontal fluid distribution tests. A uniform pressure demand for a horizontal residential fire sprinkler over a range of ceiling-to-deflector spacings would allow a fire protection system designer to have greater leeway in residential applications that are installed in accordance with the requirements of NFPA 13, 13D, and 13R (2002). Further, the more uniform pressure demand of such sprinkler would preferably provide a minimum design pressure that will allow such designer to tailor the location of sprinklers from the ceiling demanded by the design protection area for a system installed in accordance with NFPA 13, 13D, and 13R (2002).

DISCLOSURE OF INVENTION

A preferred embodiment of the present invention provides a sidewall residential sprinkler that provides a fluid distribution over a coverage area in accordance with the fluid distribution requirements of one or more applicable industry accepted standards, such as for example, NFPA 13, 13D, 13R (2002), UL Standard 1626 (October 2003) and/or Factory Mutual's (FM Approval) approval standard entitled "Approval Standard For Residential Automatic Sprinklers—Class Number 2030" (September 1983). Moreover, the preferred sprinkler satisfies the fluid distribution requirements by providing a substantially constant flow volume for a constant input or operating pressure over a range of sprinkler-to-ceiling clearance heights, preferably ranging from about four inches to about twelve inches for various coverage areas.

In one preferred embodiment, the residential fire sprinkler includes a body defining a passageway between an inlet and an outlet along a longitudinal axis. The passage preferably includes a rated K-factor of about 6. The body can further include a mounting portion having ½-inch or greater NPT threads for mounting the sprinkler to a piping system.

The preferred sprinkler also includes a closure assembly and a heat responsive trigger disposed along the longitudinal axis engaged with the closure assembly to support the closure assembly proximate the outlet opening to occlude the passageway. A pair of frame arms are preferably coupled to the body diametrically about the longitudinal axis. Further preferably provided is a boss disposed along the longitudinal axis spaced from the outlet. The pair of frame arms are preferably joined at the boss, and the boss preferably defines an inner surface which further defines a central through bore aligned with the longitudinal axis. A fastener is preferably disposed in the central bore and engaged with the heat responsive trigger.

The preferred sprinkler additionally includes a deflector coupled to the boss. The deflector includes a proximal end and a distal end so that when the trigger is actuated, the deflector provides adequate fluid distribution for the protection of a dwelling unit. The deflector preferably includes a first plate and a second plate spaced apart and disposed about one of a first and second plane intersecting along the longitudinal axis. At least one of the first and second plates, includes a first group of slots and second group of slots disposed about the second plane to adequately distribute a fire fighting fluid for the protection of a dwelling unit. Each of the first and second group of slots preferably includes at least a pair of slots, each slot having a first portion having a first width and a second portion having a second width greater than the first. A third plate or face is preferably located between the first and second plates, the third plate has a surface substantially perpendicular to the longitudinal axis, and the third plate including a first opening and a second opening disposed about the first plane, and a third opening and fourth opening disposed about the second plane.

In one preferred embodiment, the third and fourth opening are defined by an elongated slot in communication with a substantially circular through bore. Preferably, the through bore includes a chamfered surface. The third plate further preferably includes a surface forming at least one undulating surface. Preferably the undulating surface defines at least one of a concave and convex surface relative to the distal end of the deflector. Even more preferably, the undulating surface defines a radius of curvature. The radius of curvature is preferably about 0.02 inches.

In another preferred embodiment, a residential sidewall sprinkler is provided for mounting to one of two substantially parallel vertical wall surfaces extending between a substantially flat ceiling and a floor to define a coverage area for the sprinkler. The sprinkler includes a body having an inlet and an outlet defining therebetween a passageway defining a K-factor of about 6 and a longitudinal axis. The body has a proximal end for coupling the sprinkler to a fluid supply line and a distal end opposite the proximal end. The sprinkler further includes a deflector assembly having a proximal portion and a distal portion. The deflector assembly is preferably coupled to the distal end of the body, the deflector assembly including a face portion distally spaced from the outlet of the body and substantially orthogonal to a first plane and a second plane intersecting along the longitudinal axis, the face portion including at least one opening. The deflector assembly further includes a first canopy and a second canopy disposed about one of the first and second planes to define a channel therebetween in communication with the opening. At least one of the first and second canopies define a horizontal component to fluid passing between the canopies such that the deflector assembly provides at least one of a consistent horizontal and vertical fluid distribution pattern for a substantially constant fluid pressure and substantially constant fluid flow rate. The substantially constant fluid pressure and substantially constant fluid flow rate is provided for a range of ceiling-to-canopy distance between the ceiling and one of the first and second canopies, the ceiling-to-canopy distance ranging between four to about twelve inches.

Another preferred embodiment provides a residential sidewall sprinkler system that preferably includes a fluid supply, a coverage area defined by a substantially flat ceiling, a floor and at least one pair of parallel vertical walls between the ceiling and the floor. The system further includes a residential sidewall sprinkler having an actuated and a non-actuated state. The sprinkler includes a body having an inlet and an outlet defining therebetween a passageway defining a longitudinal axis and a K-factor of about 6. The body has a proximal end and a distal end opposite the proximal end. The proximal end is coupled to the fluid supply line such that the sprinkler is mounted to one of the at least one pair of vertical walls.

According to the preferred embodiment, a deflector assembly is coupled to the body to distribute fluid in the actuated state. The deflector assembly includes a face portion spaced from and substantially orthogonal to the longitudinal axis, the face portion having at least one opening, the deflector further including at least one of an upper canopy and a lower canopy axially extending about and relative to the face portion. Where the preferred sprinkler is mounted such that the at least one canopy defines a ceiling-to-deflector distance ranging from about four inches to about twelve inches. In the actuated state and the fluid supply at the inlet is at least at one of a substantially constant flow rate of fluid and substantially constant fluid pressure, the deflector assembly distributes the fluid over the coverage area so as to wet the vertical walls within about twenty-eight inches of the ceiling over the ceiling-to-deflector distance range of about four to about twelve inches.

Another preferred embodiment provides a residential sidewall sprinkler for mounting to one of two substantially parallel vertical wall surfaces extending between a substantially flat ceiling and a floor to define a coverage area for the sprinkler. The sprinkler preferably includes a body having an inlet and an outlet defining therebetween a passageway defining a K-factor of about 6 and a longitudinal axis. The body has a proximal end for coupling the sprinkler to a fluid supply line and a distal end opposite the proximal end. The preferred sprinkler further includes means to provides at least one of a consistent horizontal and vertical fluid distribution pattern for at least one of a substantially constant fluid pressure and substantially constant fluid flow rate provided to the inlet over a range of ceiling-to-sprinkler distance between the ceiling and the sprinkler. The ceiling-to-sprinkler distance ranges between four to about twelve inches.

In another preferred embodiment, a method of mounting a residential sidewall sprinkler is provided. The sprinkler includes a body and a deflector coupled to the body, and according to the method the body is to mounted to one of a pair of parallel vertical walls extending between a ceiling and a floor and defining a coverage area. The method includes securing the sprinkler to a fluid supply line at a ceiling-to-deflector distance ranging from about four inches to about twelve inches. The method further includes providing at least one of a substantially constant fluid flow rate and substantially constant fluid pressure from the fluid supply to an inlet of the body over the entire range of ceiling-to-deflector distance.

The preferred embodiment also includes distributing fluid from the sprinkler such that the vertical walls are wetted within twenty-eight inches of the ceiling over the entire ceiling-to-deflector distance for the at least one of a substantially constant flow rate and a substantially constant fluid pressure.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

MODE(S) FOR CARRYING OUT THE INVENTION

Shown in FIGS. 1-4 is an illustrative embodiment of a sidewall type, preferably horizontal, residential fire sprinkler 100 that can be used in residential applications, for example, to protect a floor area of a compartment in the residential dwelling unit. As used herein, the term "residential" is a "dwelling unit" as defined in NFPA 13D (2002) and NFPA 13R (2002), which can include commercial dwelling units (e.g., rental apartments, lodging and rooming houses, board and care facilities, hospitals, motels or hotels) to indicate one or more rooms, arranged for the use of individuals living together, as in a single housekeeping unit, that normally have cooking, living, sanitary, and sleeping facilities. The residential dwelling unit normally includes a plurality of compartments as defined in NFPA 13, 13D, and 13R (2002), where generally each compartment is a space that is enclosed by walls and ceiling.

Figure 1:
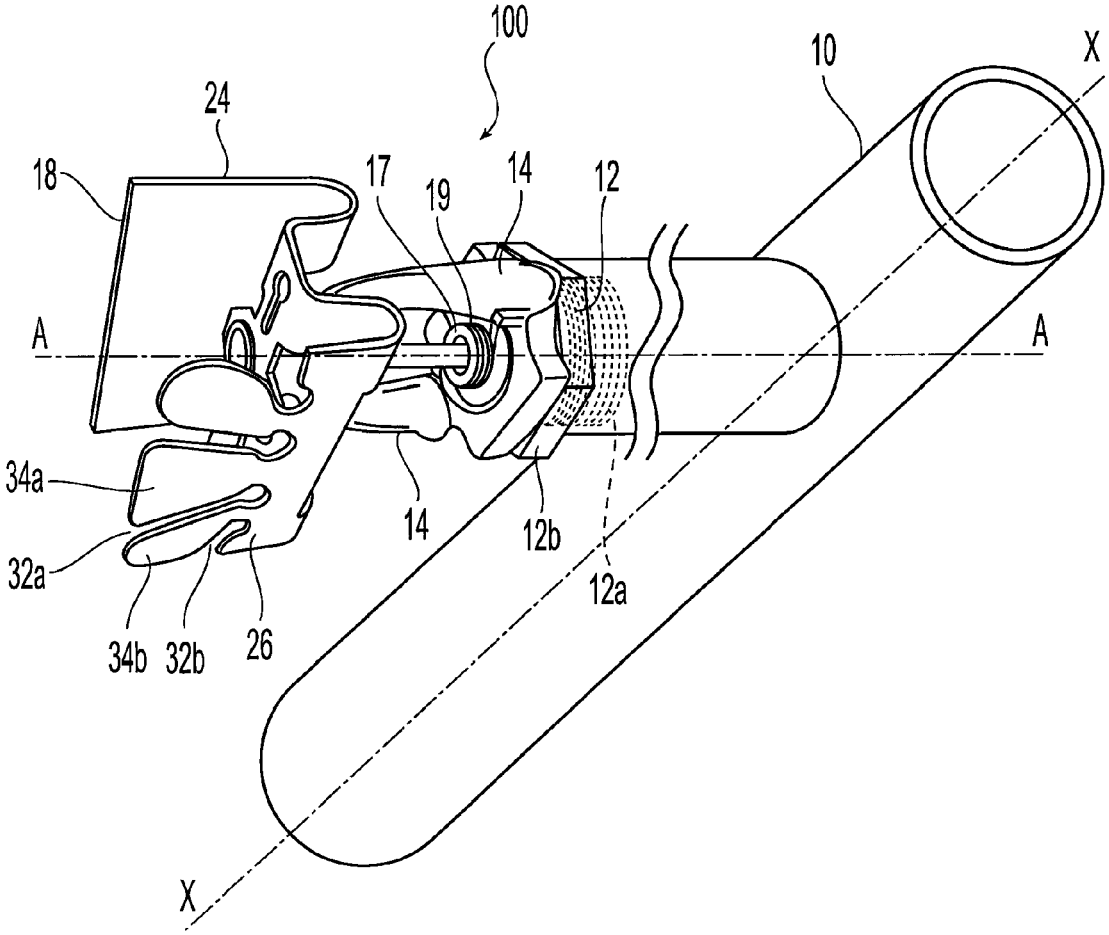
FIG. 1 is a perspective view of a preferred embodiment of the horizontal residential fire sprinkler as mounted to a branch pipe.
Figure 2:
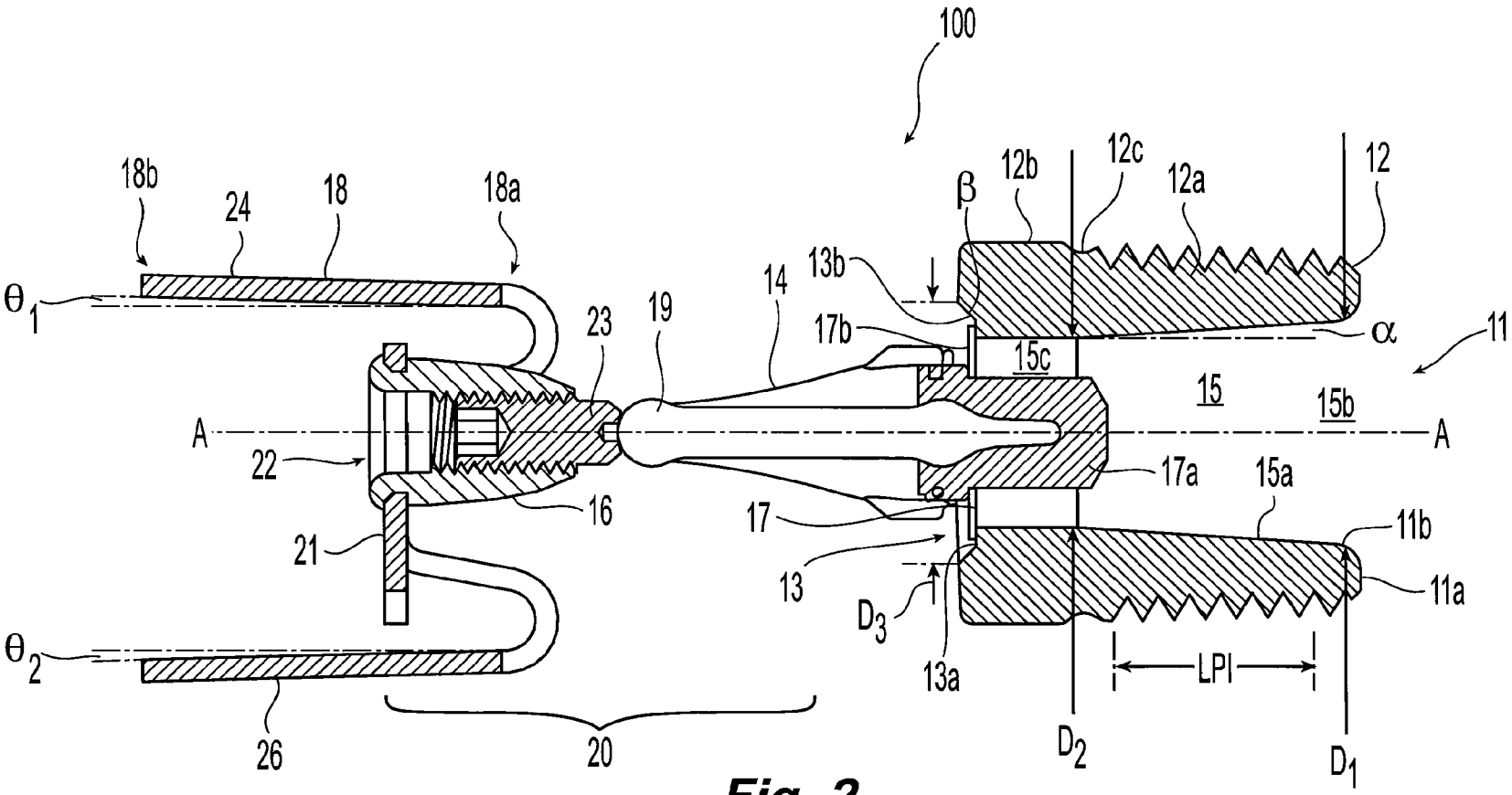
FIG. 2 is a cross-sectional view of the sprinkler of FIG. 1.

Referring to FIGS. 1 and 2, a preferred embodiment of the residential sprinkler 100 is shown mounted to fire protection piping 10 that extends along axis X-X. The residential sprinkler 100 is preferably mounted as a sidewall sprinkler oriented substantially orthogonal to axis X-X of the fire protection piping 10 to extend over the area to be protected. The sprinkler 100 has a proximal end and a distal end extending along a longitudinal axis A-A, preferably including a body 12, a deflector 18 and a pair of frame arms 14. To mount the sprinkler 100 to the sprinkler system piping, the body 12 can include an outer surface provided with a threaded portion 12*a* and multiple-flat portion 12*b* connected by a transition portion 12*c*. The threaded portion 12*a* preferably includes threads of about ½ inch National-Pipe-Thread ("NPT") and can include threads greater than ½ inch NPT. The flat portion 12*b* can include a surface for tool engagement, for example, a four-sided flat for engagement with an installation tool such as an adjustable wrench. In addition, the sprinkler 100 can be disposed within an appropriately sized escutcheon for a recessed mounting configuration.

The body 12 of sidewall residential sprinkler 100, as seen in the cross-sectional view of FIG. 2, includes an inner surface 15*a* defining a passageway 15 extending along the longitudinal axis A-A between an inlet 11 and an outlet 13. The passageway 15 preferably extends over a length of less than about one inch. The body 12 is preferably configured to define a K-factor of at least 5.8. The discharge coefficient or K-factor relates in part to the shape of the passageway 28 and other dimensions of the passageway 28 of the sprinkler 100. As used herein, a discharge coefficient or K-factor of the sprinkler 100 is quantified or rated as a flow of water Q out of a passageway 28 of the body 12 of the sprinkler 100 in gallons per minute (GPM) divided by the square root of the pressure p of water fed into body 12 in pounds per square inch gauge (psig), where $K=Q/(P)^{1/2}$.

The inlet 11 includes a generally planar entrance surface 11*a* disposed about the longitudinal axis A-A. Similarly, the outlet 13 includes a generally planar exit surface 13*a* disposed about the longitudinal axis A-A. The entrance surface 11*a* includes a compound curved portion 11*b* defined by a radiused surface rotated about the longitudinal axis A-A to define a generally bellmouth shaped surface. The radius of curvature of the bellmouth shaped surface is preferably less than about 0.1 inches. The compound curved portion 11*b* is contiguous to a proximal end of the preferably tapered linear surface 15*a* circumscribed about the longitudinal axis A-A to define a conic passageway portion 15*b* having a first length LP1 along the longitudinal axis A-A. LP1 is preferably about 0.8 inches.

The passageway 15 preferably includes a surface finish of about 100 micro-inch. The taper of the linear surface 15*a* defines a first taper angle α with respect to a line parallel to the longitudinal axis A-A. The angle α is preferably about four degrees (4°). The proximal end of the conic passageway portion 15*b* defines a first diameter D1. The first diameter D1 is preferably about 0.6 inches. The distal end of the conic passageway portion 15*b* is contiguous to a cylindrical passageway portion 15*c*. The distal end of the conic passageway 15*b* and more specifically the cylindrical passageway portion 15*c* has a second diameter D2 that is preferably about eighty-six percent of the first diameter D1. Accordingly, the diameter D2 is preferably about 0.5 inches.

The cylindrical passageway 15 is contiguous to the outlet 13 and is more specifically contiguous to a flared generally planar surface portion 13*a*, which is contiguous to a passageway chamfered portion 13*b*. The flared generally planar portion has a third diameter D3 of preferably about 110 percent of the second diameter D2. Accordingly, the third diameter D3 is preferably about 0.6 inches. The passageway chamfered portion 13*b* has a taper disposed about the longitudinal axis A-A to define a conic cylinder. The taper of the passageway chamfered portion 13*b* has a second taper angle β with respect to the longitudinal axis A-A. The second taper angle β is preferably about 45 degrees (45°). It is believed that at least the specified preferred features provide for the achievement of a rated discharge coefficient or rated K-factor of at least 6 and more preferably, about 5.8. However, the features described above can be varied so as to provide higher K-factor values provided the body and the remaining components of the sprinkler 100 are appropriately configured such that the sprinkler 100 performs in a manner as described below.

Figure 3:
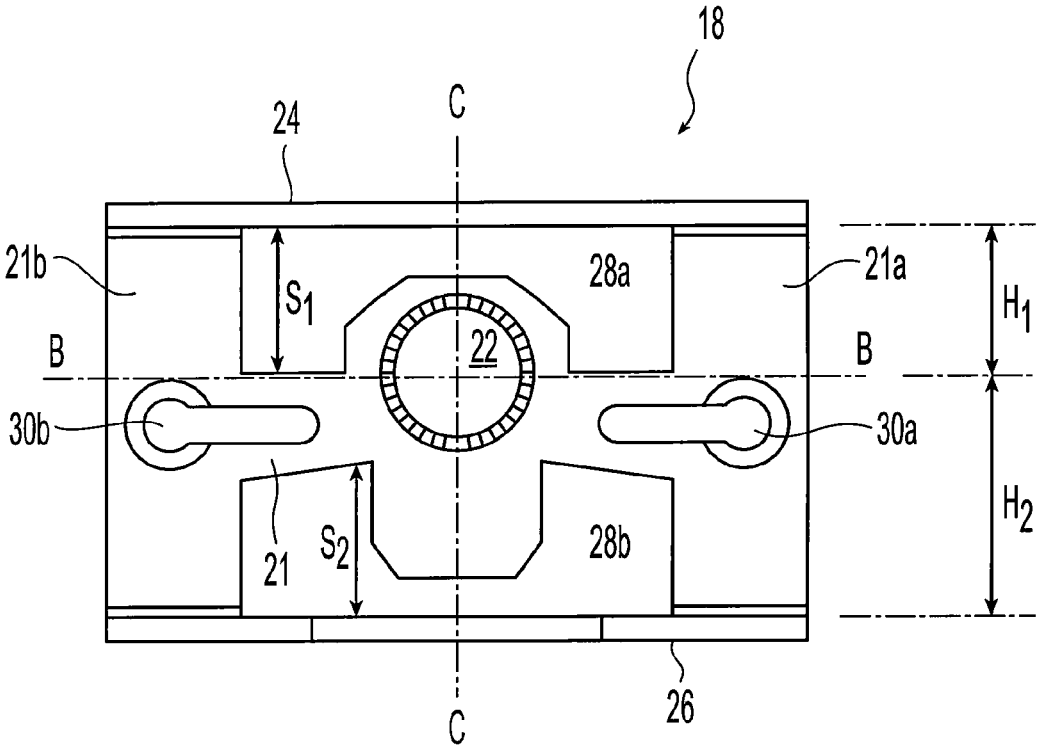
FIG. 3 is an elevation view of the sprinkler of FIG. 1 as seen by an observer directly in front of the sprinkler.

Adjacent the outlet 13 is preferably disposed a closure assembly 17 to occlude the passageway 15. The closure assembly 17 preferably includes a plug 17*a* coupled to a washer 17*b* having a perimeter contiguous to the flared planar surface 13*a*. The washer 17 is preferably a Bellville type, Beryllium Nickel washer 36 with a Teflon® coating, of about 0.02 inches. The plug 17*a* can be provided with a groove engaged with an ejection spring 17*b* coupled to the frame arms 14 as seen in FIG. 3. Supporting the closure assembly 17 proximate the outlet 13 is preferably a thermally responsive trigger 19. The trigger 40 is preferably a frangible bulb with an actuation temperature of about 155 or about 175 degrees Fahrenheit.

The sprinkler 100 includes one or more frame arms 14 disposed about the longitudinal axis. At least one of the arms includes a cross-sectional area that varies in a direction along the longitudinal axis. More specifically, the sprinkler 100 preferably includes a pair of frame arms 14 mounted to a portion of the body 12 extending longitudinally and joined at a boss 16 disposed along the longitudinal axis distal of the outlet 13. The boss 16 is preferably frusto-conical having a tip portion facing the outlet 13. The tip portion of the boss 16 is preferably disposed less than one inch from the outlet 13 of the passageway 15 and located at less than 3 inches from the inlet 11 of the body 12. The boss 16 includes an inner surface defining a through bore centered along the longitudinal axis A-A. Disposed within the through bore is a fastener 23. The fastener 23 is preferably a threaded screw member having one end engaged with a distal end of the thermally responsive trigger 19 to support the trigger and closure assembly 17 axially along the longitudinal axis. More specifically the fastener 23 is engaged with the thermally responsive trigger 19 so as to cause a deflection of the preferred washer 17*b* of the closure assembly. The through bore of the boss 16 preferably has a diameter of about 0.2 inches. The internal surface of the boss 16 threaded portion preferably has 10-32 UNF threads that extend along the longitudinal axis A-A of about 0.4 inches to engage corresponding threads on the screw member 23.

The deflector 18 preferably includes a through hole 22 to mount the deflector 18 about the boss 16 to couple the deflector 18 to the remainder of the sprinkler 100 and axially space the deflector 18 from the outlet 13 for distributing a fluid flow over the protection area. The deflector 18 further includes a proximal end 18*a* and a distal end 18*b* spaced along the longitudinal axis A-A. The axial length between the proximal and distal ends 18*a*, 18*b* of the deflector 18 defines the maximum axial length of the deflector 18.

Figure 4:
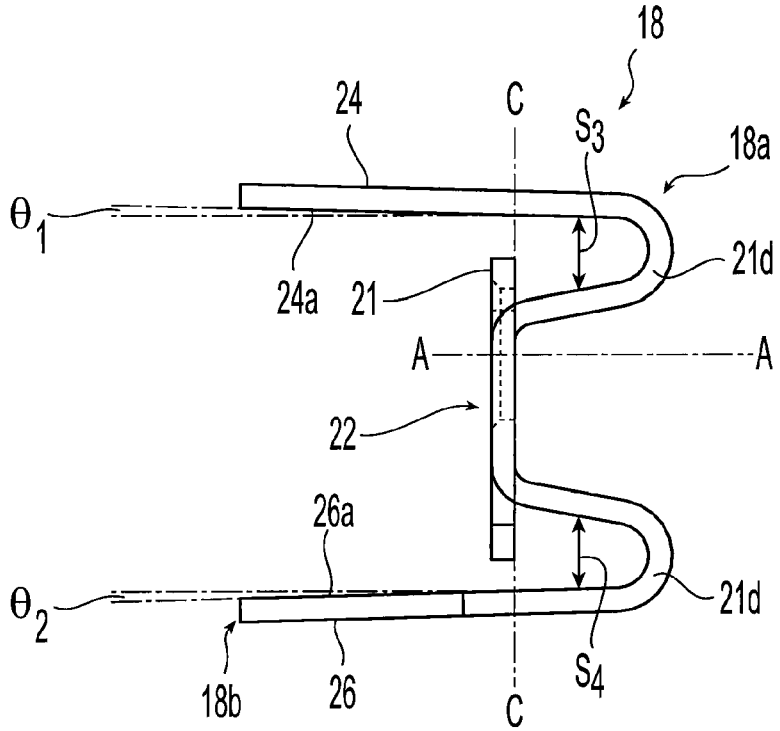
FIG. 4 is a side view of a preferred deflector used in the sprinkler of FIG. 1.

Referring to FIG. 3 and FIG. 4, the longitudinal axis A-A defines the intersection of a first plane and an orthogonal second plane. The first plane includes an axis B-B running laterally along the width of the deflector 18. The second plane includes an axis C-C running which is accordingly, substantially orthogonal to the axis B-B. Disposed about the first plane and axis B-B is a first plate or canopy 24 and a second plate or canopy 26 spaced apart from one another extending longitudinally along the axis A-A. The first and second canopies 24, 26 can include parallel inner surfaces 24*a*, 26*a* defining a deflector channel extending axially from the proximal end 18*a* to the distal end 18*b*. More preferably, the inner surfaces 24*a*, 26*a* of the first and second canopies 24, 26 define respectively first canopy angle θ1 and second canopy angle θ2 with respect to lines parallel to the longitudinal axis A-A. Preferably first and second canopy angles θ1, θ2 are about 1.5° . The first and second canopy angles can further vary over a range from zero degrees (0°) to ±thirty degrees from lines parallel to the longitudinal axis A-A provided the resultant canopy angles provide for a satisfactory water distribution as described herein.

The deflector 18 further includes a face plate 21 substantially perpendicular to the axis A-A located at the proximal end 18*a* of the deflector 18. The face plate 21 preferably defines the through bore 22 for engagement with the boss 16 to secure the deflector to the remainder of the sprinkler assembly. The face plate 21 can be mounted to the boss 16 by way of an interference fit such as, for example, by way of a flared or crimped portion of boss 16. Alternatively, the face plate 21 can be fastened to the boss 16 by a rivet. The face plate 21 extends along the axis C-C between the first and second canopies 24, 26. Preferably, face plate 21 is substantially contiguous with the first and second canopies 24, 26, and more preferably, the face plate 21 is integrally formed with the first and second canopies 24, 26. In addition, at least a portion of the face plate 21 preferably extends longitudinally along the longitudinal axis A-A.

In one preferred embodiment of the deflector 18, the face plate 21 includes parallel undulating lateral portions, 21*a* and 21*b* disposed about preferably equidistantly about the second plane and axis C-C, as seen in FIG. 3. Each of lateral portions 21*a* and 21*b* preferably have a pair of undulations 21*d* contiguous with the first and second canopies 24, 26. The undulations 21*d* preferably define concave curvatures relative to the distal end 18*b* of the deflector 18 having a radius of curvature ranging from about 0.05 to about 0.1 inches and more preferably about 0.07 inches. The undulating lateral portions 21*a*, 21*b* preferably locate a central portion of the face plate 21 and the through bore 22 between the proximal and distal ends 18*a*, 18*b* of the deflector 18. More preferably, the proximal side of the through bore is disposed at about 0.5 to about 0.75 inches and even more preferably about 0.6 inches from the distal end 18*b* of the deflector 18. Accordingly, where the center of the radii of curvatures for undulations 21*d* is substantially axially aligned with the proximal ends of first and second canopies 24, 26, the radii of curvature of the undulations is such so as to define a ratio of face plate 21 height along the axis C-C to canopy axial length from proximal canopy end to distal canopy end along the longitudinal axis A-A of about 1:1 or more specifically 1.036 to 1. The undulations 21*d* further preferably define convex curvatures relative to the distal end 18*b* of the deflector 18 having a radius of curvature of about 0.01 to about 0.05 inches and more preferably about 0.02 inches.

The face plate 21 includes one or more openings providing communication between the sprinkler 100 proximal the deflector 18 to the deflector channel between the first and second canopies 24, 26, as seen for example in FIG. 2 and FIG. 3. Preferably, the face plate 21 includes openings 28*a* and 28*b* disposed about the first plane and laterally extending axis B-B. The openings 28*a* and 28*b* are preferably polygonal and defined by the lateral portions 21*a* and 21*b* and central portion of the face plate 21. The openings 28*a*, 28*b* can be defined by continuous straight or curvilinear edges or any combination thereof provided the resulting opening permits sufficient communication between the deflector channel and the outlet of the body 12 that water is adequately distributed in a manner described herein. In addition, the face plate 21 further preferably includes two lateral openings 30*a* and 30*b* disposed about the second plane and axis C-C. The lateral openings 30*a*, 30*b* preferably include a slot portion substantially parallel to the axis B-B. The lateral openings 30*a*, 30*b* further preferably include bore portions respective disposed on the lateral portions 21*a*, 21*b* and in communication with the slot portions which extend centrally toward the through bore 22. More preferably, the bore portions of lateral openings 30*a*, 30*b* are chamfered at about a forty-five degree angle, and more preferably at (0.040×45°).

The sprinkler 100 is preferably configured for mounting as a sidewall horizontal sprinkler and the deflector is further preferably configured to effect a desired fluid distribution. More specifically, the deflector 18 is configured such that the sprinkler satisfies the requirements of at least one test, such as for example, UL Standard 1626 (October 2003). In a sidewall configuration, the deflector 18 and its face plate 21, in combination with the boss 16 and frame arms 14, present to the outlet 13 of the body 12 a deflecting assembly 20 for deflecting fire fighting fluid, such as water, discharged from the outlet 13 of the body 12. The water deflected by the assembly 20 is directed, at least in-part back toward the body 12, the frame arms 14 and additionally through the openings 28 and 30 in the face plate 21 of the deflector 18. More specifically, where the sprinkler 100 is mounted on a sidewall over a protection area defined by the sidewall, at least two adjacent walls and an opposing sidewall, the sprinkler 100 and its deflection assembly 20 is preferably configured to provide a fluid distribution over the protection area thereby wetting the mounting sidewall, the adjacent sidewalls, opposing sidewalls and protection area to satisfy water density requirements for known fluid distribution tests such as, for example, UL Standard 1626 (October 2003).

Accordingly, the deflector 18 alone or in combination with one or more of the boss 16, portions of the frame arms 14 and the body 12 can provide the means for distributing a fluid discharged from the outlet 13 in a manner that satisfies UL Standard 1626 (October 2003). Water passing through the openings 28, 30 of the face plate 21 can be deflected by an inner surface of a canopy 24, 26 and directed along the channel of the deflector 18. Water entering the deflector channel is further distributed in a pattern over the protection area as defined by the first and second canopies 24, 26. When the deflector 18 is mounted in a sidewall configuration preferably beneath a ceiling, the first canopy 24 preferably defines an upper canopy to further define a ceiling-to-deflector spacing, and the second canopy defines a lower canopy relative to the first plane and axis B-B. The ceiling is preferably a flat ceiling extending perpendicularly from the top of the wall to which the sprinkler 100 is mounted or alternatively is defined by an imaginary plane extending perpendicularly from the top of the vertical wall to which the sprinkler 100 is mounted. The canopies 24, 26 preferably define two distinct horizontal components to the fluid or water distribution passing between the canopies. Preferably, there is an upper horizontal component and a lower horizontal component to the distribution. The lower horizontal component can provide a lift to the upper horizontal component such that the deflector assembly 20 provides a consistent spray or distribution over the range of ceiling-to-deflector spacing of about four inches to twelve inches. More preferably provided is a consistent flow volume for a constant fluid input pressure at the sprinkler body 12. The upper canopy 24 is preferably located at a first height H1 above the axis B-B and the lower canopy 28 is located at a second height H2 below the axis B-B.

In a preferred embodiment H1 is smaller than H2 to allow more water or fire suppressant fluid to be directed downwards and back to the sidewall from which the sprinkler 100 extends. The ratio of H1 to H2 can be a function of the number and size of undulations 21*d* in the face plate 21 continuous with the upper and lower canopies 24, 26. For example, where H1 is about 0.3 inches and H2 is about 0.5 inches, the face plate 21 can have four undulations: (i) two concave undulations relative to the distal end 18*b* having a radii of curvatures of about 0.07 inches at respective centers about 0.22 inches and 0.43 inches from the longitudinal axis A-A; and (ii) two convex undulations relative to the distal end 18*b* having respective centers about 0.03 inches and 0.24 inches from the longitudinal axis A-A.

In a preferred embodiment of the deflector 18, as seen for example in FIG. 1, the deflector 18 includes one or more slots 32 formed in the lower canopy 26 to distribute the water over the protection area. Preferably, the lower canopy 26 includes a first group of slots and a second group of slots disposed about the second plane and axis C-C. Each of the first and second group of slots includes a first slot 32*a* and at least a second slot 32*b*. Preferably, each slot has a preferably straight elongated portion extending in the distal to proximal direction and terminating in a circular portion. Moreover, the first slot 32*a* preferably initiates from the distal end of the canopy 26 and the second slot preferably initiates from a lateral side of the canopy 26. The straight portion of the slot 32 defines a first slot width and the circular portion defines a second slot width preferably greater than the first slot width. In addition, the first slot 32*a* preferably defines a slot length greater than a second slot length defined by the second slot 32*b*.

The straight elongated portion of each slot 32 is preferably formed by a pair of parallel walls in the lower canopy 26. Alternatively, the walls forming the slot 32 may be tapered relative to the inner surface of the lower canopy 26, i.e. a chamfer, and further alternatively may taper toward one another so as to define a narrowing or broadening slot width. The walls forming the elongated portions of slots 32 can further define a slot angle relative to the axis C-C. Accordingly in the preferred embodiment of FIGS. 1 and 4, the first slot 32*a* in each of the group of slots defines an slot angle δ1, as more specifically seen for example in FIG. 5, ranging from about fifteen degrees (15°) to about twenty-five degrees (25°) and more preferably about twenty degrees (20°) relative to the axis C-C. Preferably, the second slot 32*a* in each of the group of slots defines an slot angle δ2 ranging from about sixty-five degrees (65°) to about seventy-five degrees (75°) and more preferably about seventy degrees (70°) relative to the axis C-C. The slots 32 are believed to facilitate a fluid distribution over a floor or coverage area that meets the fluid collection requirements of various test standards such as, for example, a first test define by UL Standard 1626 (October 2003) which is incorporated by reference in its entirety.

The one or more slot groups formed in the lower canopy 26 further form or define therebetween one or more tines 34. As seen in the preferred embodiment of FIGS. 1 and 5, disposed between the first slots 32 of the first and second group of slots is a first tine 34*a*. The first tine 34*a* includes at least two lateral edges defined by the slot angles of the adjacent first slots 32*a* disposed about the axis C-C. The first tine 34*a* is further preferably defined by an edge between the lateral edges. Preferably, the first tine 34 includes the distal edge of the lower canopy 26 which is preferably substantially orthogonal to the second plane and axis C-C. Alternatively, the distal edge of the canopy forming the first tine 34 can be polygonal or have a curved profile. Further preferably formed between each of the first and second slots 32*a*, 32*b* is a second tine 34*b*. The second tine 34*b* includes at least two lateral edges defined by the respective slot angles of the first and second slots 32*a* and 32*b*. The edge of the tine 34*b* between the lateral edges of the tine 34*b* is preferably a curved profile defined by one or more radii of curvatures.

Figure 5:
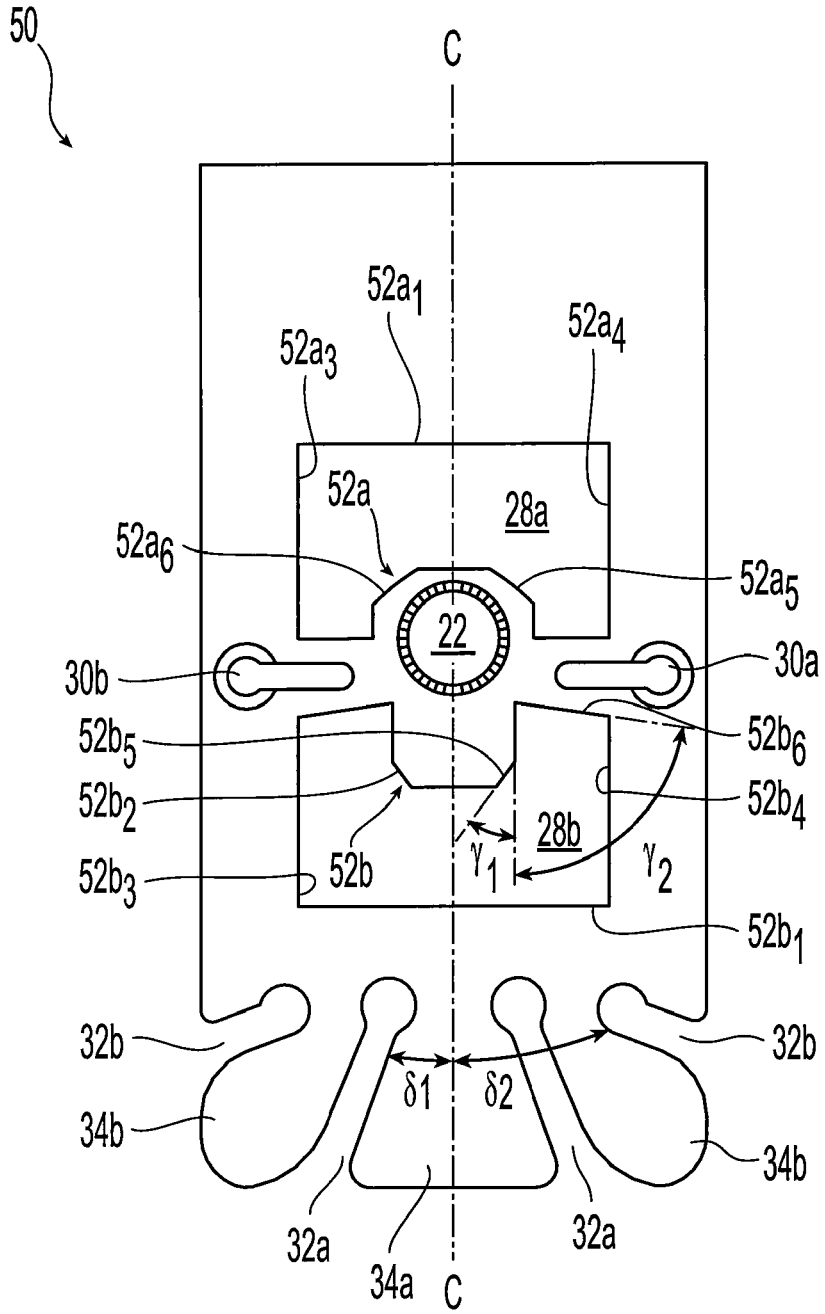
FIG. 5 is a plan view of a deflector assembly blank before stamping.

The preferred deflector 18 can be stamped from a single or integral metal member. More specifically, shown in FIG. 5 is a metal plate or blank of unitary construction having a central through bore 22 and openings 28*a*, 28*b* disposed about the bore 22. In addition, the metal blank 50 can include formed therein, the lateral slots 30*a*, 30*b* along with the preferred first and second slot groups 32*a*, 32*b*. The blank 50 can be placed in a stamping machine or other metal break device to form the deflector 18. The stamping process preferably forms the upper canopy 24, the lower canopy 26 and the face plate 21 therebetween. Moreover, the stamping process further preferably forms the undulating lateral portions 21*a*, 21*b* to locate a central portion of the face plate between the proximal and distal ends 18*a*, 18*b* of the deflector 18.

As previously described above, the openings 28*a*, 28*b* are preferably bound by multiple edges and ultimately defined or framed by portions of the face plate 21 and canopies 24, 26. Preferably, the blank 50 includes closed-formed edges 52*a*, 52*b* disposed about, and more preferably disposed above and below, the through bore 22 to respectively frame the openings 28*a*, 28*b*. Preferably, upper edge 52*a* and lower edge 52*b* each define a symmetrical profile about the axis C-C. Upper edge 52*a* can include n edges $\mathbf{52}a_1$ through $\mathbf{52}a_n$ of the nth edge. For example, edge 52*a* can include at least two parallel edges $\mathbf{52}a_1$ and $\mathbf{52}a_2$ that are perpendicular to the axis C-C and at least two parallel edges $\mathbf{52}a_3$ and $\mathbf{52}a_4$ that are parallel to the axis C-C. Preferably, the edge $\mathbf{52}a_1$ defines a length perpendicular to the axis C-C of about 0.75 inch to about one inch and is more preferably about 0.95 inches and the edge $\mathbf{52}a_2$ is preferably spaced from the center of the bore 22 at about 0.15 inch to about 0.25 inch and is preferably spaced at about 0.20 inches. The edge $\mathbf{52}a_3$ preferably defines a length parallel to the axis C-C of about 0.5 inch to about 0.75 inch and is more preferably about 0.57 inches. The upper edge 52*a* further preferably includes one or more edges defining a radius of curvature. More preferably, the edge 52*a* includes one or more curvilinear edges $\mathbf{52}a_5$, $\mathbf{52}a_6$ having a radius of curvature of about 0.5 inch to about one inch and is more preferably about 0.66 inch.

Similarly lower edge 52*b* can includes n edges $\mathbf{52}b_1$ through $\mathbf{52}b_r$, of the nth edge. For example, edge 52*a* can include at least two parallel edges $\mathbf{52}b_1$ and $\mathbf{52}b_2$ that are perpendicular to the axis C-C and at least two parallel edges $\mathbf{52}b_3$ and $\mathbf{52}b_4$ that are parallel to the axis C-C. Preferably, the edge $\mathbf{52}b_1$ defines a length perpendicular to the axis C-C of about 0.75 inch to about one inch and is more preferably about 0.95 inches and the edge $\mathbf{52}b_2$ is spaced from the center point of bore 22 by about 0.3 in to about 0.5 inch and is preferably spaced at about 0.45 inch. The edge $\mathbf{52}b_3$ preferably defines a length parallel to the axis C-C of about 0.5 inch to about 0.75 inch, more preferably about 0.55 inch to about 0.6 inch, and is even more preferably about 0.57 inch. The lower edge 52*b* further preferably includes one or more edges defining an acute or obtuse angle relative to the axis C-C. More preferably, the edge 52*b* includes edge $\mathbf{52}b_5$ defining an included angle $\gamma_1$ with a line parallel to axis C-C. Included angle $\gamma_1$ preferably ranges from about thirty degrees to about forty-five degrees and is more preferably about thirty-seven degrees. The edge 52*b* further preferably includes edge $\mathbf{52}b_6$ defining another angle $\gamma_2$ with a line parallel to the axis C-C. Angle $\gamma_2$ preferably ranges from about seventy-five degrees to about eighty-five degrees and is about eighty-two degrees.

When the blank 50 is stamped to finally form the deflector 18, as seen for example in FIG. 3 and FIG. 4, the edges 52*a*, 52*b* form a face plate 21 having a surface profile to define upper spacings $s_1$ and $s_3$ relative to the upper canopy 24 that vary respectively along the axis B-B and longitudinal axis A-A, and further define lower spacings $s_2$ and $s_4$ relative to the lower canopy 26 that vary respectively along the axis B-B and longitudinal axis A-A. The variable spacings $s_1$, $s_2$, $s_3$, and $s_4$ between the surfaces and edges of the face plate 21 and the canopies 24, 26 locate the surfaces and edges of the face plate 21 to deflect fluid discharge passing through the openings 28*a*, 28*b* and impart a fluid velocity to achieve a desired fluid distribution.

Figure 6A:
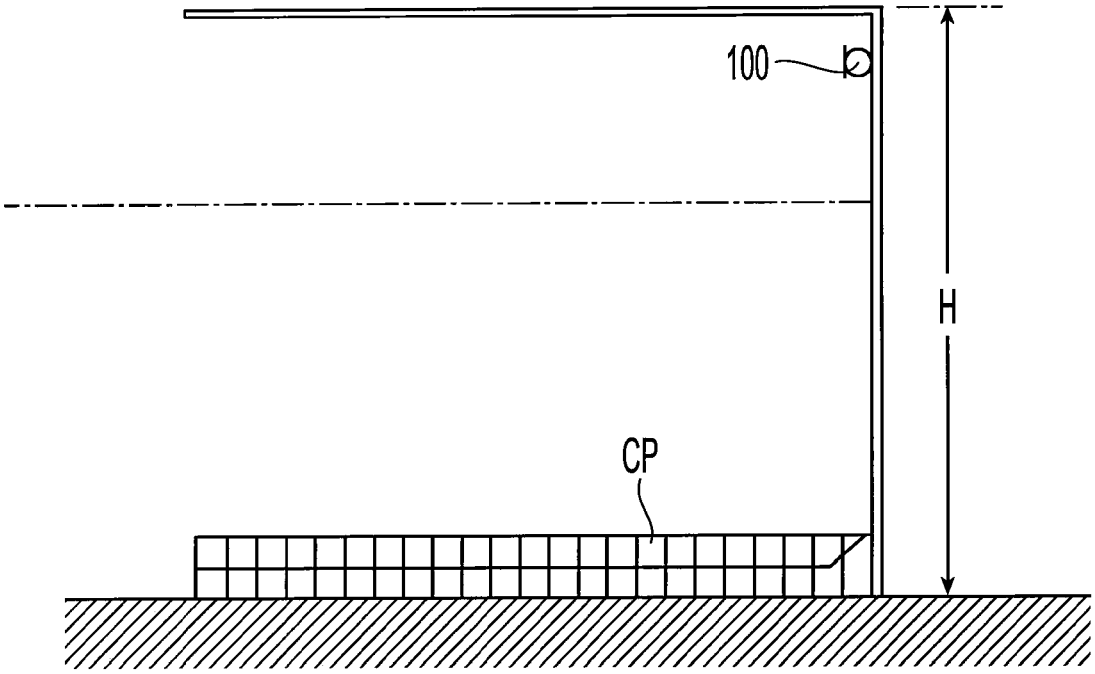
FIG. 6A is a plan view of a sprinkler in a test room to determine a vertical water distribution.
Figure 6B:
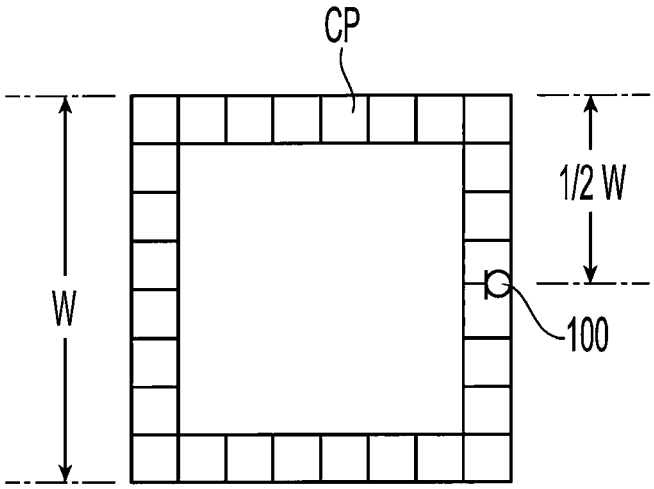
FIG. 6B is a top plan view of a vertical water distribution of the room of FIG. 6.
Figure 6C:
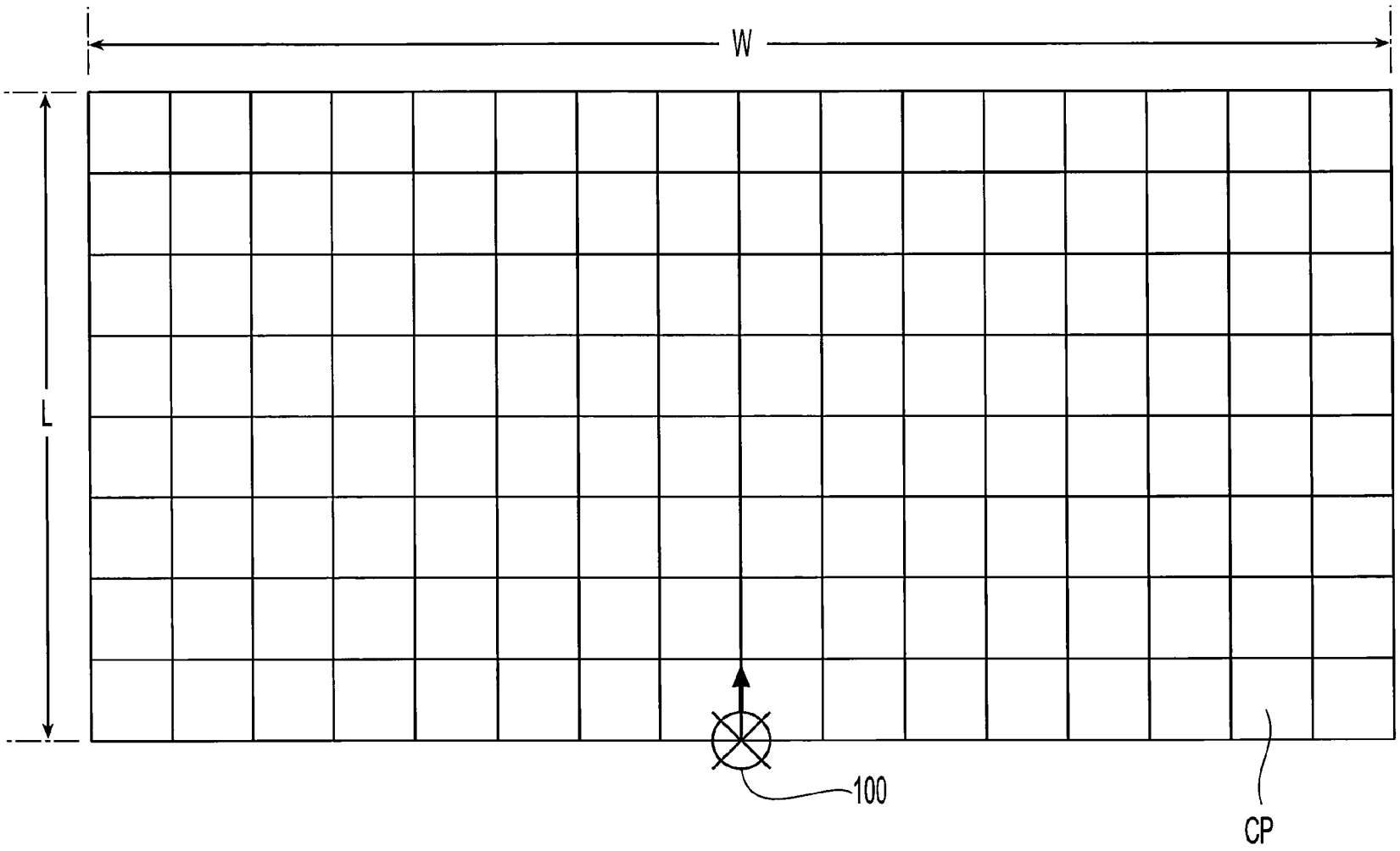
FIG. 6C illustrates a plan view of a layout for water collection pans in a horizontal fluid distribution test.

It is believed that the various features of the sprinkler 100 and its deflector assembly 20 allow for compliance with various fluid distribution tests over a range of sprinkler-to-ceiling mounting distances at relatively or substantially constant flow and pressure demands. More specifically, for a given coverage area, the features of the sprinkler 100 meet the testing requirements of at least the first test, such as previously discussed UL Standard 1626 (October 2003) having a vertical fluid distribution tests, the set up of which is illustrated in FIGS. 6A and 6B, and a horizontal fluid distribution test, the set up of which is illustrated in FIG. 6C. The preferred sprinkler 100 can satisfy such fluid distribution tests at a relatively or substantially constant fluid pressure and fluid flow rate over a range of ceiling-to-deflector spacing ranging from four to twelve inches.

While the sprinkler 100, its body 12, arms 14, boss 16 and deflector 18 constructed in accordance with preferred embodiments described herein can individually and collectively provides a means for generating a desired fluid distribution over a range of sprinkler-to-ceiling mounting distances at relatively constant flow and pressure demands, it is believed that the features of the sprinkler 100 can be varied while maintaining the desired fluid flow parameters. For example, one or more preferred features of the sprinkler 100 described herein can be alternatively combined in varying combinations and/or eliminated from a preferred embodiment provided the sprinkler 100 can maintain the performance described herein.

As promulgated by Section 27 of UL Standard 1626 (October 2003), the preferred first test is provided for an arrangement to determine the vertical fluid distribution of any sprinkler suitable for the protection of a dwelling unit. In the test arrangement for the residential sidewall sprinkler 100, the sprinkler 100 is placed over coverage area (CA) at one-half the coverage length (CL) or width (CW) (FIGS. 6A and 6B) of the coverage area. A suitable fire-fighting fluid such as water is delivered to the sprinkler 100 at a specified flow rate with the sprinkler 100 being tested via a one-inch internal diameter pipe. Water collection pans of one-square foot area are placed on the floor against the walls of the test area so that the top of the pan is six feet, ten inches below a nominally eight feet height H generally flat ceiling. The duration of the test is ten minutes at which point the walls within the coverage area should be wetted to within twenty-eight inches (28 in.) of the ceiling at the specified design flow rate. Where the coverage area (CA) is square, each of the four walls must be wetted with at least five percent of the sprinkler flow. Where the coverage area (CA) is rectangular, each of the four walls must be wetted with a proportional water amount collected that is generally equal to twenty percent (20%) times a total discharge of the sprinkler 100 at the rated flow rate of the residential fire sprinkler times the length of the wall divided by the perimeter of coverage area (CA). The sprinkler 100 can be subjected to a second test which can include alternate performance and/or test requirements, or alternatively provide a vertical fluid distribution test having substantially similar wall wetting requirements to that of the first test described above.

The first test further preferably includes a horizontal fluid distribution test of UL Standard 1626 (October 2003) which requires placing a selected sprinkler 100 over a protective area with the sprinkler 100 placed in the center of one of the walls. A detailed layout of the protective area is illustrated in FIG. 6C. In this arrangement, water collection pans are placed over the protective area so that each square foot of the coverage area is covered by collector pan of one-square foot area. For sidewall sprinklers, the top of the collector pan is six feet, ten inches (6 ft.-10 in.) below a generally flat ceiling of the test area, FIG. 6A. The amount of fluid collected is about 0.02 gallons per minute per square foot for any of the collection pans except that no more than eight collection pans for each half of the protective area receive at least 0.015 gallons per minute per square foot. Each half is defined by the sprinkler center line.

Water or a suitable fire fighting fluid is supplied to the selected sprinkler 100 at a desired rate with the sprinkler 100 being tested via a one-inch internal diameter pipe with a T-fitting having an outlet at substantially the same internal diameter as the inlet 11 of the selected sprinkler 100. The duration of the test is twenty-minutes and at the completion of the test, the water collected by the collection pans CP (as delineated by the square like grid) is measured to determine if the amount deposited complies with the minimum density requirement for each coverage area. The sprinkler 100 can be subjected to a second test which can include alternate performance and/or test requirements, or alternatively provide a horizontal fluid distribution test having substantially similar wall wetting requirements to that of the first test described above.

In addition or alternatively to the above described fluid distribution tests, the preferred first test includes actual fire tests performed in accordance with Section 28 of UL Standard 1626 (October 2003). In particular, the fire test can be performed with sprinkler 100 to limit the temperature in a location of the test area so as to satisfy the criteria of Section 28.1 of UL Standard 1626 (October 2003). More specifically, a test area with simulated furniture fuel package can be constructed with the preferred sprinklers 100 installed in accordance with Section 28.2 of UL 1626. According to Section 28.2, the fuel package requires the use of a three inch thick foam pad mounted about a plywood backing. In particular, Section 28.2 of UL Standard 1626 (October 2003) provides that the simulated furniture be constructed using two-three inch thick uncovered pure polypropylene oxide polyol, polyether foam cushions each measuring thirty inches-by-thirty-two inches (30 in.×32 in.) glued to a plywood backing.

The sprinkler 100 can be further subjected to the second test, which in addition or alternatively to the fluid distribution tests described above, can include an actual fire test. The preferred fire test of the second test would be similar to the that outlined by Section 28.2 of UL Standard 1626 (October 2003), however the preferred fuel package would use a three-inch thick, wider foam pad preferably measuring about thirty inches-by-thirty-four inches (30 in.×34 in.). The wider foam pad provides for a greater heat release rate in the fire test as compared to the UL fire test. Accordingly, the inventors believe that a fire test using the wider foam pad in the fuel package presents a more stringent standard as compared to UL 1626 (October 2003). Moreover, the second test is believed to be substantially similar to the Factory Mutual's (FM Approval) draft approval standard entitled "Automatic Residential Mode Sprinklers For Fire Protection—Class Number 2030" (September 2005 Draft).

Actual fire tests conducted with sprinkler 100 can limit temperatures for each rated spacing as specified by the installation requirements having no more than two sprinklers 10 operate, such that: (i) the maximum temperature three inches below the ceiling at the tested locations does not exceed 600° F. (316° C.); (ii) the maximum temperature five and one-quarter feet (5¼ ft.) above the floor shall not exceed 200° F. nor exceed 130° F. for more than any continuous two minute period; and (iii) the maximum ceiling temperature ¼ inch behind the finished ceiling surface shall not exceed 500° F. (260° C.).

Under the flat ceiling vertical and horizontal fluid distribution tests of UL Standard 1626 (October 2003), the preferred embodiment of the sprinkler 100, rated at either 155° F. or 175° F. and having a body 12 and deflector assembly 20 as described above, provides a minimum flow rate of water at least about twenty-nine gallons per minute (29 GPM.) and no more than thirty gallons per minute (30 GPM.) at a minimum pressure of at least about twenty-five pounds per square inch gauge (25 psig.) and no more than about twenty-seven pounds per square inch gauge (26.8 psig.) respectively fed to the inlet 11 of the sprinkler 100 to further provide a satisfactory density of water to a coverage area of 18 feet by 18 feet (324 sq. ft.) over a range of ceiling-to-deflector spacing of four inches to twelve inches. Table 1 below shows the results obtained for sprinkler 100 based for various coverage areas for the same range of ceiling-to-deflector spacing under the preferred first test, "UL Standard 1626 (October 2003)" and the preferred second test. For each coverage area, the flow rate and pressure was measured at two different distances (four inches and twelve inches) of the sprinkler 100 below the ceiling. According to the results for a given size protection area under a given test standard, the flow and pressure requirements satisfying the preferred test standards at a four inch ceiling-to-deflector spacing were substantially the same at a ceiling-to-deflector spacing of twelve inches.

TABLE 1

| | First Test "UL Standard 1626 (October 2003)" | | | Second Test | | |
|---|---|---|---|---|---|---|
| Coverage Area | Ceiling-to-Deflector Spacing | Sprinkler 100 Flow (GPM) | Sprinkler 100 Pressure (psi) | Ceiling-to-Deflector Spacing | Sprinkler 100 Flow (GPM) | Sprinkler 100 Pressure (psi) |
| 12 × 12 | 4" | 19 | 10.7 | 4" | 21 | 13.1 |
| 12 × 12 | 12" | 19 | 10.7 | 12" | 21 | 13.1 |
| 14 × 14 | 4" | 21 | 13.1 | 4" | 21 | 13.1 |
| 14 × 14 | 12" | 23 | 15.7 | 12" | 22 | 14.4 |
| 16 × 16 | 4" | 21 | 13.1 | 4" | 22 | 14.4 |
| 16 × 16 | 12" | 23 | 15.7 | 12" | 24 | 17.1 |
| 16 × 18 | 4" | 23 | 15.7 | 4" | 28 | 23.3 |
| 16 × 18 | 12" | 24 | 17.1 | 12" | 28 | 23.3 |
| 16 × 20 | 4" | 29 | 25.0 | 4" | 31 | 28.6 |
| 16 × 20 | 12" | 30 | 26.8 | 12" | 32 | 30.4 |
| 16 × 22 | 4" | 38 | 42.9 | 4" | — | — |
| 16 × 22 | 12" | 40 | 47.6 | 12" | — | — |
| 18 × 18 | 4" | 29 | 25.0 | 4" | 33 | 32.4 |
| 18 × 18 | 12" | 30 | 26.8 | 12" | 33 | 32.4 |

Summarized in Table 2 is the percent variance for the fluid flow rate and the fluid pressure for each coverage area over the deflector spacing range of four to twelve inches under each standard.

TABLE 2

| | First Test "UL Standard 1626 (October 2003)" | | | Second Test | | |
|---|---|---|---|---|---|---|
| Coverage Area | Ceiling-to-Deflector Spacing Range | Sprinkler 100 Percent Flow Variance | Sprinkler 100 Percent Pressure Variance | Ceiling-to-deflector Spacing | Sprinkler 100 Percent Flow Variance | Sprinkler 100 Percent Pressure Variance |
| 12 × 12 | 4"-12" | 0.00 | 0.00 | 4"-12" | 0.00 | 0.00 |
| 14 × 14 | 4"-12" | 9.52 | 19.95 | 4"-12" | 4.76 | 9.75 |
| 16 × 16 | 4"-12" | 9.52 | 19.95 | 4"-12" | 9.09 | 19.01 |
| 16 × 18 | 4"-12" | 4.35 | 8.88 | 4"-12" | 0.00 | 0.00 |
| 16 × 20 | 4"-12" | 3.45 | 7.02 | 4"-12" | 3.23 | 6.56 |
| 16 × 22 | 4"-12" | 5.26 | 10.80 | 4"-12" | — | — |
| 18 × 18 | 4"-12" | 0.00 | 0.00 | 4"-12" | 0.00 | 0.00 |

The greatest variability in fluid flow rate and pressure for the sprinkler 100, when going from a four inch to a twelve inch ceiling-to-deflector spacing, was measured in a fourteen foot by fourteen foot coverage area and a sixteen foot by sixteen foot area in which the flow increased about ten percent and the pressure increased by about twenty percent. Known sidewall sprinklers are believed to require a variance in the fluid pressure as much as nearly ninety percent (90%) and a fluid flow rate variance of nearly thirty-eight percent (38%) for a square coverage area of 12 feet by 12 feet. For rectangular coverage areas, known sprinklers are known to have a variance in fluid flow rate as much as nearly twenty-three percent (23%) and a fluid pressure variance of nearly fifty-two percent (52%) over the ceiling-to-deflector spacing ranging from four inches to twelve inches. Unlike the known sprinklers, the preferred sprinkler 100 in fluid flow test over a non-square coverage area and more particularly over a rectangular coverage area, satisfies each of the first and second test with a percent variance in fluid flow rate of less than six percent (6%) and percent variance in fluid pressure of less than eleven percent (11%). Accordingly, a sprinkler configured in accordance with the preferred embodiments described herein, provides for a sprinkler having a substantially more constant and thus more predictive sprinkler performance over a range of possible ceiling-to-deflector spacings. Thus, sprinkler system design is simplified by minimizing the variability in flow output and pressure input requirements when using a sidewall horizontal sprinkler in a protection area having ceiling-to-deflector clearance issues. Moreover, it is believed that where there is a variance for the sprinkler 100 in flow rate and fluid pressure for the range of ceiling-to-deflector distance and for a given coverage area, the higher flow rate and minimum pressure at the larger ceiling-to-deflector spacing, i.e. 12 inches, can be utilized at a lower ceiling-to-deflector spacing, i.e. 4 inches, to satisfy the fluid distribution requirements while minimizing the overall discharge.

Because the preferred embodiments of the sprinkler 100 are able to pass all of the performance tests required by UL Standard 1626 (October 2003), the preferred embodiments are able to be listed by a listing authority, such as, for example, UL, for design and installation as a residential fire sprinkler, as defined in Section 3.6.2.10 of NFPA 13 (2002).

While the present invention has been disclosed with reference to certain preferred embodiments, numerous modifications, alterations, and changes to the described embodiments are possible without departing from the sphere and scope of the present invention. Accordingly, it is intended that the present invention not be limited to the described embodiments, but that it have the full scope defined by the language of the following claims, and equivalents thereof.

We claim:

1. A residential sidewall sprinkler for mounting to one of two substantially parallel vertical wall surfaces extending between a substantially flat ceiling and a floor to define a coverage area for the sprinkler, the sprinkler comprising:

a body having an inlet and an outlet defining therebetween a passageway defining a K-factor of about 6 and a longitudinal axis, the body having a proximal end for coupling the sprinkler to a fluid supply line, the body having a distal end opposite the proximal end;

a deflector assembly having a proximal portion and a distal portion, the deflector assembly being coupled to the distal end of the body such that the proximal end of the deflector is adjacent the distal end of the body, the deflector assembly including:

a face portion distally spaced from the outlet of the body and substantially orthogonal to a first plane and a second plane intersecting along the longitudinal axis, the face portion including a pair of openings and a pair of parallel lateral portions, each of the lateral portions includes a first plurality of undulating portions, and a second plurality of undulating portions disposed about one of the first and second planes, the first and second plurality of undulations defining a concave radius of curvature relative to the distal portion of the deflector assembly, the deflector assembly further including:

a first canopy contiguous with the first plurality of undulating portions and a second canopy contiguous with the second plurality of undulating portions, the first and second canopies disposed about the one of the first and second planes to define a channel therebetween in communication with the opening, each of the first and second canopies bounding a respective one of the pair of openings, and each of the first and second canopies extending proximally and distally of the face portion, the second canopy having a distal end including a plurality of tines including at least one tine defined by a distal edge of the second canopy.

2. The residential sidewall sprinkler of claim 1, wherein the deflector assembly provides a consistent vertical fluid distribution pattern, the consistent vertical fluid distribution pattern being that the wall surfaces are wetted within twenty-eight inches of the ceiling.

3. The residential sidewall sprinkler claim 1, wherein the deflector assembly provides a consistent horizontal fluid distribution pattern, the longitudinal axis bi-sects the coverage area into a first half of the coverage area and a second half of the coverage area, the consistent horizontal fluid distribution pattern providing a density of about 0.02 gallons per minute per square foot and no more than eight square feet in either the first or second half of the coverage area receive at least 0.015 gallons per minute per square foot.

4. The residential sidewall sprinkler of claim 1, wherein the sprinkler is further disposed between a second pair of substantially parallel walls such that the coverage area is square, the consistent vertical fluid distribution pattern providing that each of the two pairs of walls are wetted by at least five percent of the fluid flow volume.

5. The residential sidewall sprinkler of claim 1, wherein the sprinkler is further disposed between a second pair of substantially parallel walls such that the coverage area is rectangular, the consistent vertical fluid distribution pattern providing that each of the two pairs of walls are wetted by about twenty percent of a discharge volume for the sprinkler at the rated flow rate for the sprinkler times the length of the coverage area divided by the width of the coverage area.

6. The sprinkler of claim 1, wherein the deflector is coupled to the body by a pair of frame arms, the frame arms being joined by a boss mounted to the face portion of the deflector.

7. The sprinkler of claim 6, wherein the boss is substantially frusto-conical.

8. The residential sidewall sprinkler of claim 6, wherein the at least one opening includes a substantially circular bore having a center point disposed along the longitudinal axis, the boss being disposed in the circular bore.

9. The residential sprinkler of claim 1, wherein at least one of the first and second canopies define a canopy angle relative to a plane parallel to the one of the first and second planes about which the first and second canopies are disposed.

10. The residential sprinkler of claim 9, wherein the canopy angle ranges from about zero degrees to about thirty degrees.

11. The residential sprinkler of claim 9, wherein the canopy angle is about 1.5 degrees.

12. The residential sprinkler of claim 1, wherein the first plurality of undulations is integral with the first canopy and the second plurality of undulation is integral with the second canopy.

13. The residential sprinkler of claim 12, wherein the first and second plurality of undulating portions locates a central portion of the face portion between the proximal and distal ends of the deflector assembly.

14. A residential sidewall sprinkler for mounting to one of two substantially parallel vertical wall surfaces extending between a substantially flat ceiling and a floor to define a coverage area for the sprinkler, the sprinkler comprising:

a body having an inlet and an outlet defining therebetween a passageway defining a K-factor of about 6 and a longitudinal axis, the body having a proximal end for coupling the sprinkler to a fluid supply line, the body having a distal end opposite the proximal end;

a deflector assembly having a proximal portion and a distal portion, the deflector assembly being coupled to the distal end of the body such that the proximal end of the deflector is adjacent the distal end of the body, the deflector assembly including:

a face portion distally spaced from the outlet of the body and substantially orthogonal to a first plane and a second plane intersecting along the longitudinal axis, the face portion including a pair of openings, the deflector assembly further including:

a first canopy and a second canopy disposed about one of the first and second planes to define a channel therebetween in communication with the opening, at least one of the first and second canopies defining a horizontal component to fluid passing between the canopies such that the deflector assembly provides at least one of a consistent horizontal and vertical fluid distribution pattern for at least one of a substantially constant fluid pressure and substantially constant fluid flow rate provided to the inlet over a range of ceiling-to-canopy distance between the ceiling and one of the first and second canopies, the ceiling-to-canopy distance ranging between four to about twelve inches, each of the first and second canopies bounding a respective one of the pair of openings, and each of the first and second canopies extending proximally and distally of the face portion, the second canopy having a distal end including a plurality of tines including at least one tine defined by a distal edge of the second canopy, wherein the face portion includes a pair of parallel lateral portions, each of the lateral portions includes a plurality of undulating portions integral with first and second canopies, the plurality of undulations define a concave radius of curvature relative to the distal portion of the deflector assembly, the plurality of undulations further defining a ratio between the height of the face portion and a length of the first and second canopies of about 1.1.

15. A residential sidewall sprinkler for mounting to one of two substantially parallel vertical wall surfaces extending between a substantially flat ceiling and a floor to define a coverage area for the sprinkler, the sprinkler comprising:

a body having an inlet and an outlet defining therebetween a passageway defining a K-factor of about 6 and a longitudinal axis, the body having a proximal end for coupling the sprinkler to a fluid supply line, the body having a distal end opposite the proximal end;

a deflector assembly having a proximal portion and a distal portion, the deflector assembly being coupled to the distal end of the body such that the proximal end of the deflector is adjacent the distal end of the body, the deflector assembly including:

a face portion distally spaced from the outlet of the body and substantially orthogonal to a first plane and a second plane intersecting along the longitudinal axis, the face portion including a pair of openings, the deflector assembly further including:

a first canopy and a second canopy disposed about one of the first and second planes to define a channel therebetween in communication with the opening, at least one of the first and second canopies defining a horizontal component to fluid passing between the canopies such that the deflector assembly provides at least one of a consistent horizontal and vertical fluid distribution pattern for at least one of a substantially constant fluid pressure and substantially constant fluid flow rate provided to the inlet over a range of ceiling-to-canopy distance between the ceiling and one of the first and second canopies, the ceiling-to-canopy distance ranging between four to about twelve inches, each of the first and second canopies bounding a respective one of the pair of openings, and each of the first and second canopies extending proximally and distally of the face portion, the second canopy having a distal end including a plurality of tines including at least one tine defined by a distal edge of the second canopy, wherein the face portion includes a pair of parallel lateral portions, each of the lateral portions includes a plurality of undulating portions integral with first and second canopies, the plurality of undulations define a concave radius of curvature relative to the distal portion of the deflector assembly and a convex curvature relative to the distal end of the deflector assembly, the radius of curvature ranging from about 0.1 inches to about 0.5 inches.

16. The residential sprinkler of claim 1, wherein the pair of openings is disposed about one of the first and second planes.

17. The residential sprinkler of claim 1, wherein at least one of the pair of openings is polygonal.

18. The residential sprinkler of claim 1, wherein the face portion includes an elongated slot portion in communication with a substantially circular bore portion.

19. The residential sprinkler of claim 1, wherein the one of the first and second canopies define a shorter distance than the other canopy relative to the one of the first and second planes about which the first and second canopies are disposed.

20. The residential sprinkler of claim 1, wherein at least one of the first and second canopies includes a plurality of slots, each slot having one end initiating from an edge of the canopy, the slot extending with an elongate portion and terminating in a circular portion in communication with the elongate portion.

21. The residential sprinkler of claim 20, wherein the plurality of slots include a first group of slots initiating from a lateral edge of the at least one canopy, the plurality of slots including a second group of slots initiating from a distal edge of the canopy.

22. The residential sprinkler of claim 20, wherein plurality of slots include at least one slots having a portion with a first width and a second portion with a second width different than the first width.

23. The residential sprinkler of claim 20, wherein the plurality of slots include a first group of slots each having a first width and a first length, the plurality of slots having second group of slots, each having a second width different than the first width and a second length different than the first length.

24. The residential sprinkler of claim 20, wherein the plurality of slots include a first group of slots each defining a first slot angle relative to a line parallel to the one of the first and second plane symmetrically bisecting the deflector assembly, the plurality of slots including a second group of slots each defining a second slot angle relative to the line different than first angle, the first slot angle ranging from about fifteen degrees to about twenty-five degrees and the second slot angle ranging from about sixty-five to about seventy-five degrees.

25. The residential sprinkler of claim 1, wherein the consistent horizontal and vertical fluid distribution satisfy at least one of the fluid distribution tests of UL Standard 1626 (Oct. 2003) and at least a second test.

26. The residential sprinkler of claim 1, wherein for the ceiling-to-canopy distance range, the substantially constant fluid pressure and substantially constant fluid flow rate consists of: (i) for a coverage area of twelve foot-by-twelve foot, the fluid flow rate varying by zero percent and the fluid pressure varying by zero percent; (ii) for a coverage area of fourteen foot-by-fourteen foot, the fluid flow rate varying by no more than ten percent and the fluid pressure varying by no more than twenty percent; (iii) for a coverage area of sixteen foot-by-sixteen foot, the fluid flow rate varying by no more than ten percent and the fluid pressure varying by no more than twenty percent; (iv) for a coverage area of sixteen foot-by-eighteen foot, the fluid flow rate varying by no more than five percent and the fluid pressure varying by no more than nine percent; (v) for a coverage area of sixteen foot-by-twenty foot, the fluid flow rate varying by no more than four percent and the fluid pressure varying by no more than eight percent; (vi) for a coverage area of eighteen foot-by-eighteen foot, the fluid flow rate varying by zero percent and the fluid pressure varying by zero percent.

27. The residential sprinkler of claim 1, wherein the K-factor is 5.8.

28. A residential sidewall sprinkler system comprising:

a fluid supply;

a coverage area defined by a substantially flat ceiling, a floor and at least one pair of parallel vertical walls between the ceiling and the floor;

a residential sidewall sprinkler having an actuated and a non-actuated state, the sprinkler including:

a body having an inlet and an outlet defining therebetween a passageway defining a longitudinal axis and a K-factor of about 6, the body having a proximal end and a distal end opposite the proximal end, the proximal end being coupled to the fluid supply line such that the sprinkler is mounted one of the at least one pair of vertical walls;

a deflector assembly having a proximal portion and a distal portion, the deflector assembly coupled to the distal end of the body such that the proximal end of the deflector is adjacent the distal end of the body to distribute fluid in the actuated state, the deflector assembly including a face portion spaced from and substantially orthogonal to a first plane and a second plane intersecting along the longitudinal axis, the face portion having a pair of openings, a first plurality of undulating portions and a second plurality of undulating portions disposed about the first plane, each of the first and second plurality of undulating portions defining a concave radius of curvature relative to the distal portion of the deflector assembly, the deflector further including an upper canopy contiguous with the first plurality of undulating portions and a lower canopy axially contiguous with the second plurality of undulating portions, the upper and lower canopies extending about the first plane and relative to the face portion, each of the upper and lower canopies extending proximally and distally of the face portion, and each of the upper and low canopies bounding a respective one of the pair of openings.

29. The system of claim 28, wherein further the sprinkler is mounted so that the longitudinal axis symmetrically bi-sect the coverage area into a first half and the second half, the deflector assembly distributes the fluid over the floor of the coverage area so as to provide a density of about 0.02 gallons per minute per square foot and no more the eight square feet in either the first or second half of the coverage area receiving at least 0.015 gallons per minute per square foot.

30. The system of claim 29, wherein the coverage area includes a second pair of parallel walls such that the coverage area is substantially square, the deflector assembly distributing fluid such that each of the two pairs of parallel walls are wetted by at least five percent of the fluid flow volume.

31. The system of claim 29, wherein the coverage area includes a second pair of parallel walls such that the coverage area is substantially rectangular, the deflector assembly distributing fluid such that each of the two pairs of walls are wetted by about twenty percent of a discharge volume for the sprinkler at the rated flow rate for the sprinkler times the length of the coverage area divided by the width of the coverage area.

32. The system of claim 28, wherein the ceiling-to-deflector distance is one of four and twelve inches and the coverage area is twelve foot-by-twelve foot, the flow rate is about 19 gallons per minute (GPM) and the fluid pressure is about 10.7 pounds per square inch (psi.).

33. The system of claim 28, wherein the ceiling-to-deflector distance is one of four and twelve inches and the coverage area is twelve foot-by-twelve foot, the flow rate is about 21 gallons per minute (GPM) and the fluid pressure is about 13 pounds per square inch (psi.).

34. The system of claim 28, wherein the ceiling-to-deflector distance is one of four and twelve inches and the coverage area is fourteen foot-by-fourteen foot, the flow rate ranges from about 21-23 gallons per minute (GPM) and the fluid pressure ranges from about 13-16 pounds per square inch (psi.).

35. The system of claim 28, wherein the ceiling-to-deflector distance is one of four and twelve inches and the coverage area is fourteen foot-by-fourteen foot, the flow rate ranges from about 21-22 gallons per minute (GPM) and the fluid pressure ranges from about 13-14 pounds per square inch (psi.).

36. The system of claim 28, wherein the ceiling-to-deflector distance is one of four and twelve inches and the coverage area is sixteen foot-by-sixteen foot, the flow rate ranges from about 21-23 gallons per minute (GPM) and the fluid pressure ranges from about 13-16 pounds per square inch (psi.).

37. The system of claim 28, wherein the ceiling-to-deflector distance is one of four and twelve inches and the coverage area is sixteen foot-by-sixteen foot, the flow rate ranges from about 22-24 gallons per minute (GPM) and the fluid pressure ranges from about 14-17 pounds per square inch (psi.).

38. The system of claim 28, wherein the ceiling-to-deflector distance is one of four and twelve inches and the coverage area is sixteen foot-by-eighteen foot, the flow rate ranges from about 23-24 gallons per minute (GPM) and the fluid pressure ranges from about 16-17 pounds per square inch (psi.).

39. The system of claim 28, wherein the ceiling-to-deflector distance is one of four and twelve inches and the coverage area is sixteen foot-by-eighteen foot, the flow rate is about 28 gallons per minute (GPM) and the fluid pressure is about 23 pounds per square inch (psi.).

40. The system of claim 28, wherein the ceiling-to-deflector distance is one of four and twelve inches and the coverage area is sixteen foot-by-twenty foot, the flow rate ranges from about 29-30 gallons per minute (GPM) and the fluid pressure ranges from about 25-27 pounds per square inch (psi.).

41. The system of claim 28, wherein the ceiling-to-deflector distance is one of four and twelve inches and the coverage area is sixteen foot-by-twenty foot, the flow rate ranges from about 32-33 gallons per minute (GPM) and the fluid pressure ranges from about 29-30 pounds per square inch (psi.).

42. The system of claim 28, wherein the ceiling-to-deflector distance is one of four and twelve inches and the coverage area is eighteen foot-by-eighteen foot, the flow rate is about 29 gallons per minute (GPM) and the fluid pressure is about 25 pounds per square inch (psi.).

43. The system of claim 28, wherein the ceiling-to-deflector distance is one of four and twelve inches and the coverage area is eighteen foot-by-eighteen foot, the flow rate is about 33 gallons per minute (GPM) and the fluid pressure is about 32 pounds per square inch (psi.).

44. The system of claim 28, wherein the deflector assembly distributes the fluid flow so as to satisfy at least one of the fluid distribution tests of UL Standard 1626 (Oct. 2003) and at least a second test.

45. The system of claim 28, wherein the K-factor is 5.8.

46. A residential sidewall sprinkler for mounting to one of two substantially parallel vertical wall surfaces extending between a substantially flat ceiling and a floor to define a coverage area for the sprinkler, the sprinkler comprising:

a body having an inlet and an outlet defining therebetween a passageway defining a K-factor of about 6 and a longitudinal axis, the body having a proximal end for coupling the sprinkler to a fluid supply line, the body having a distal end opposite the proximal end; and means to provide at least one of a consistent horizontal and vertical fluid distribution pattern for at least one of a substantially constant fluid pressure and substantially constant fluid flow rate provided to the inlet over a range of ceiling-to-sprinkler distance ranging between four to about twelve inches, the means comprising a first canopy and a second canopy disposed about a plane that includes the longitudinal axis, the means including a first plurality of undulations contiguous with the first canopy and a second plurality of undulations contiguous with the second canopy, each of the first and second canopies bounding a respective one of a pair of openings, the first and second plurality of undulations being disposed about the plane with each of the first and second plurality of undulating portions defining a concave radius of curvature relative to a face portion of the deflector assembly, each of the first and second canopies extending distally of the first and second plurality of undulations and away from the body, at least one of the first and second canopies having a distal end including a plurality of tines including at least one tine defined by a distal edge of the respective canopy.

47. The sprinkler of claim 46, wherein at least one of the first and second canopies includes a plurality of slots, each slot having one end initiating from an edge of the canopy, the slot extending with an elongate portion and terminating in a circular portion in communication with the elongate portion.

48. The residential sprinkler of claim 46, wherein at least one of the first and second canopies includes a plurality of slots, the plurality of slots include a first group of slots initiating from a lateral edge of the at least one canopy, the plurality of slots including a second group of slots initiating from a distal edge of the canopy.

49. The residential sprinkler of claim 46, wherein at least one of the first and second canopies includes a plurality of slots, the plurality of slots include at least one slots having a portion with a first width and a second portion with a second width different than the first width.

50. The residential sprinkler of claim 46, wherein at least one of the first and second canopies includes a plurality of slots, the plurality of slots includes a first group of slots each having a first width and a first length, the plurality of slots having second group of slots, each having a second width different than the first width and a second length different than the first length.

51. The residential sprinkler of claim 47, wherein at least one of the first and second canopies includes a plurality of slots, the plurality of slots include a first group of slots each defining a first slot angle relative to a line parallel to the one of the first and second plane symmetrically bisecting the deflector assembly, the plurality of slots including a second group of slots each defining a second slot angle relative to the line different than first angle, the first slot angle ranging from about fifteen degrees to about twenty-five degrees and the second slot angle ranging from about sixty-five to about seventy-five degrees.

52. The sprinkler of claim 46, wherein the at least one of a consistent horizontal and vertical fluid distribution pattern define a coverage area that is rectangular and wherein further the fluid flow rate varies no more than six percent and the fluid pressure varies no more than eleven percent over the ceiling-to-deflector range.

53. The residential sprinkler of claim 1, wherein the first plurality of undulating portions being integral with first canopy and the second plurality of undulating portions being integral with the second canopy, the first and second plurality of undulations define a ratio between the height of the face portion and a length of the first and second canopies of about 1:1.

54. The residential sprinkler of claim 1, wherein the first plurality of undulating portions being integral with first canopy and the second plurality of undulating portions being integral with the second canopy, the first and second plurality of undulations define a convex curvature relative to the distal end of the deflector assembly, the radius of curvature ranging from about 0.1 inches to about 0.5 inches.

* * * * *